US010263370B2

(12) United States Patent
Condo et al.

(10) Patent No.: US 10,263,370 B2
(45) **Date of Patent: *Apr. 16, 2019**

(54) INTERNALLY SWITCHED FEMALE RECEPTACLE OR CONNECTOR WITH PLUG-LATCHING SAFETY INTERLOCK

(71) Applicant: Hubbell Incorporated, Shelton, CT (US)

(72) Inventors: Mark Andrew Condo, Seymour, CT (US); Thomas Louis Scanzillo, Monroe, CT (US); William Henry Dietz, Branford, CT (US); William Ramon Valentin, Meriden, CT (US)

(73) Assignee: Hubbell Incorporated, Shelton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/811,019

(22) Filed: Nov. 13, 2017

(65) Prior Publication Data

US 2018/0102612 A1 Apr. 12, 2018

Related U.S. Application Data

(63) Continuation of application No. 15/013,060, filed on Feb. 2, 2016, now Pat. No. 9,819,127, which is a (Continued)

(51) Int. Cl.
*H01R 13/62* (2006.01)
*H01R 13/707* (2006.01)
(Continued)

(52) U.S. Cl.
CPC ..... *H01R 13/707* (2013.01); *H01R 13/641* (2013.01); *H01R 13/6456* (2013.01);
(Continued)

(58) Field of Classification Search
CPC ..... H01R 13/447; H01R 13/4534; H01R 13/4536; H01R 27/00; H01R 13/62933; H01R 13/622; H01R 13/64
(Continued)

(56) References Cited

U.S. PATENT DOCUMENTS 3,360,764 A * 12/1967 Bac ..... H01R 13/635 439/155
3,599,167 A 8/1971 Adrian
(Continued)

OTHER PUBLICATIONS

PCT/US2017/054840 International Search Report and Written Opinion dated Oct. 20, 2017 (8 pages).

*Primary Examiner* — Thanh Tam T Le
(74) *Attorney, Agent, or Firm* — Michael Best & Friedrich, LLP

(57) ABSTRACT

An internally switched female receptacle or connector for use with IEC 60309-2 configuration plugs and the like. Various plug-latching and plug-actuated safety interlock arrangements coordinate strictly axial plug movement relative to the receptacle with the closing and opening of sleeve contacts and terminal pressure contacts. A continuous ground feature ensures grounding of the primary electrical circuit throughout plug insertion and withdrawal. An optional low-current lighting control circuit powers an LED status indicator. A modular clocking design enables variable angular positioning of the terminals during manufacture.

18 Claims, 36 Drawing Sheets

Related U.S. Application Data continuation of application No. 13/815,726, filed on Mar. 15, 2013, now Pat. No. 9,252,539.

(60) Provisional application No. 61/722,001, filed on Nov. 2, 2012.

(51) Int. Cl.

| | |
|---|---|
| ***H01R 13/645*** | (2006.01) |
| ***H01R 13/71*** | (2006.01) |
| ***H01R 13/641*** | (2006.01) |
| *H01R 13/08* | (2006.01) |
| *H01R 13/717* | (2006.01) |

(52) U.S. Cl.
CPC ..... *H01R 13/71* (2013.01); *H01R 13/08* (2013.01); *H01R 13/7175* (2013.01)

(58) Field of Classification Search
USPC ..... 439/135–138, 173, 310, 312, 677, 680
See application file for complete search history.

(56) References Cited

U.S. PATENT DOCUMENTS

| | | | | |
|---|---|---|---|---|
| 3,982,804 | A | 9/1976 | Marechal | |
| 4,109,095 | A | 8/1978 | Kling et al. | |
| 4,140,358 | A | 12/1979 | Marechal | |
| 4,176,905 | A | 12/1979 | Marechal | |
| 4,488,765 | A * | 12/1984 | Erbe | H01R 13/44 439/137 |
| 4,525,610 | A | 6/1985 | Le Magourou | |
| 4,553,000 | A | 11/1985 | Appleton | |
| 4,659,160 | A | 4/1987 | Jonval | |
| 4,678,254 | A | 7/1987 | Le Magourou | |
| 4,784,611 | A | 11/1988 | Poulin et al. | |
| 4,925,396 | A | 5/1990 | Grover | |
| 5,007,857 | A | 4/1991 | Wright | |
| 5,044,977 | A | 9/1991 | Vindigni | |
| 5,055,057 | A | 10/1991 | Boyer | |
| 5,071,360 | A | 12/1991 | Lindow et al. | |
| 5,234,350 | A | 8/1993 | Marechal et al. | |
| 5,234,357 | A | 8/1993 | Yamaguchi | |
| 5,244,409 | A | 9/1993 | Guss, III et al. | |
| 5,334,032 | A | 8/1994 | Myers et al. | |
| 5,478,249 | A | 12/1995 | Crestin | |
| 5,503,569 | A | 4/1996 | Huss, Jr. et al. | |
| 5,577,920 | A | 11/1996 | Itou | |
| 5,626,485 | A | 5/1997 | Clyatt, III | |
| 5,702,266 | A | 12/1997 | Jones | |
| 5,743,752 | A | 4/1998 | Massebeuf | |
| 5,897,387 | A | 4/1999 | Vallet et al. | |
| 5,944,550 | A | 8/1999 | Vindigni | |
| 5,980,278 | A | 11/1999 | Winkler | |
| 6,056,578 | A | 5/2000 | Lin | |
| 6,109,938 | A | 8/2000 | Meslet et al. | |
| 6,302,726 | B1 | 10/2001 | Marechal | |
| 6,319,042 | B2 | 11/2001 | Hirschmann | |
| 6,382,990 | B1 | 5/2002 | Marechal | |
| 6,410,868 | B1 | 6/2002 | Berlemont et al. | |
| 6,431,888 | B1 | 8/2002 | Crestin | |
| 6,479,773 | B2 | 11/2002 | Bienvenu | |
| 6,682,361 | B2 | 1/2004 | Zweigle | |
| 6,685,513 | B2 | 2/2004 | Bienvenu | |
| 6,786,754 | B2 | 9/2004 | Yamaoka et al. | |
| 6,825,417 | B2 | 11/2004 | Ball | |
| 6,890,006 | B2 | 5/2005 | Crestin et al. | |
| 7,081,024 | B2 | 7/2006 | Karadimas et al. | |
| 7,147,518 | B2 | 12/2006 | Marechal et al. | |
| 7,182,614 | B2 | 2/2007 | Crestin | |
| 7,249,976 | B1 | 7/2007 | Watson | |
| 7,422,486 | B2 | 9/2008 | Hoff et al. | |
| 7,452,222 | B2 | 11/2008 | McIntire et al. | |
| 7,491,080 | B2 | 2/2009 | Alami et al. | |
| 7,575,450 | B2 | 8/2009 | Williams et al. | |
| 7,811,115 | B1 | 10/2010 | Tyler | |
| 8,011,938 | B2 | 9/2011 | Martin et al. | |
| 8,092,240 | B2 | 1/2012 | Alami et al. | |
| 8,105,106 | B1 | 1/2012 | Stoddard | |
| 8,221,150 | B2 | 7/2012 | Alami et al. | |
| 8,502,499 | B2 | 8/2013 | Xiao | |
| 8,772,655 | B2 | 7/2014 | Lee | |
| 8,876,539 | B2 * | 11/2014 | Gette | H01R 13/453 439/137 |
| 8,882,525 | B2 * | 11/2014 | Mori | B60L 11/1818 439/310 |
| 8,894,426 | B2 * | 11/2014 | Gette | H01R 13/447 439/137 |
| 8,968,021 | B1 | 3/2015 | Kennedy | |
| 9,252,539 | B2 | 2/2016 | Condo | |
| 9,368,911 | B2 | 6/2016 | Charnesky et al. | |
| 9,819,127 | B2 * | 11/2017 | Condo | H01R 13/6456 |
| 2012/0088393 | A1 | 4/2012 | Siebens | |
| 2014/0127926 | A1 | 5/2014 | Condo et al. | |
| 2016/0141800 | A1 | 5/2016 | Charnesky et al. | |
| 2016/0156140 | A1 | 6/2016 | Condo et al. | |

* cited by examiner

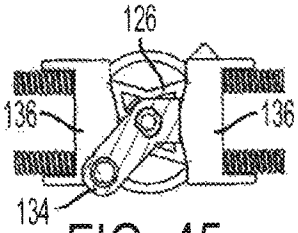
FIG. 45
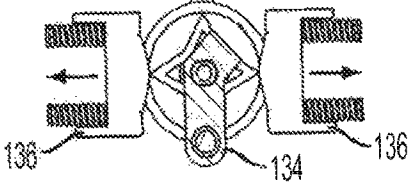
FIG. 46
FIG. 47
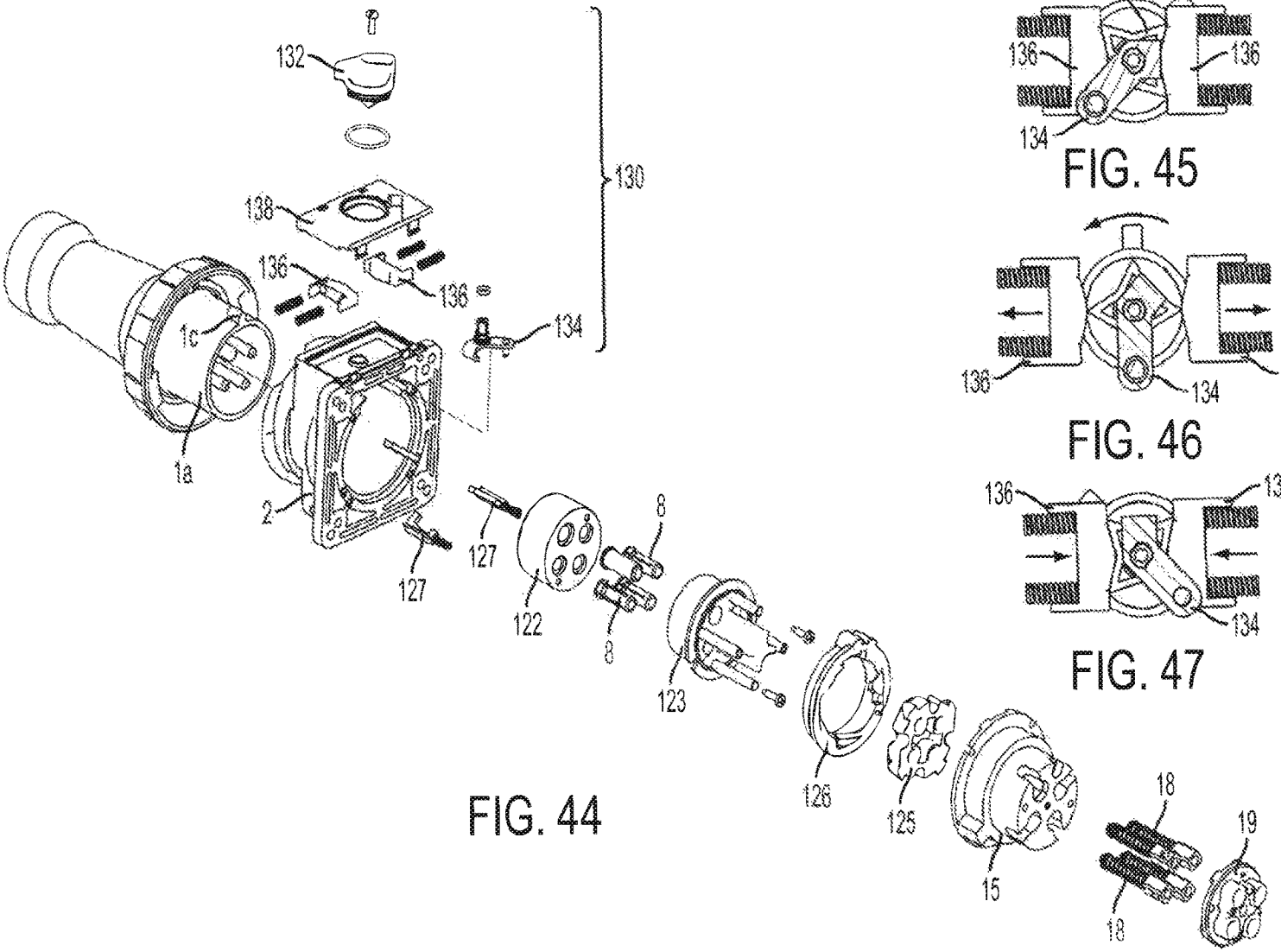
FIG. 44

INTERNALLY SWITCHED FEMALE RECEPTACLE OR CONNECTOR WITH PLUG-LATCHING SAFETY INTERLOCK

CROSS-REFERENCE TO RELATED APPLICATION

This application is a continuation of patent application Ser. No. 15/013,060, filed Feb. 2, 2016, which is a continuation of patent application Ser. No. 13/815,726, filed Mar. 15, 2013, which claims the benefit of provisional patent application No. 61/722,001, filed Nov. 2, 2012, the disclosure of which are incorporated by reference herein in their entirety.

FIELD OF THE INVENTION

This invention relates to electrical connectors, in particular to IEC 60309-2 configuration pin-and-sleeve (plug and receptacle) devices, which are usually offered in amperage ratings 16/20 A, 30/32 A, 60/63 and 100/125 A in various voltage ratings and in various pin/sleeve configurations. These products are used worldwide and are built and tested to IEC 60309-1 and -2 standards. They also are UL-Listed for North American applications under UL standards 1682 and 1686.

BACKGROUND OF THE INVENTION

Standard pin and sleeve devices typically are comprised of a male plug having "pins" and a female connector or receptacle (connected to a power source) having mating sleeve-like contacts ("sleeves"). Some form of plug-to-receptacle latching usually is provided at least to prevent accidental separation of those components. The electrical connection is made through the mechanical insertion of the plug pins into the receptacle sleeves.

For safety reasons, the receptacle's sleeves must not be energized or accessible unless a mating plug is properly and fully inserted. Several types of arrangements afford such protection:

- Type I: These devices employ an apertured, plug-displaceable safety disc that covers the "live" sleeves when no plug is present.
- Type II: In these devices the sleeves are internally switched with respective "live" inner contacts and are kept open when no plug is present to automatically provide an exposed "dead face" (see, e.g., U.S. Pat. Nos. 4,659,160 and 4,488,765).
- Type III: These devices add to the Type II arrangement an external actuator for manually closing and opening the internal (sleeve and inner) switch contacts only when the plug and the receptacle are joined and for preventing their separation when the switch contacts are closed (see, e.g., U.S. Pat. Nos. 4,140,358 and 4,678,254).

SUMMARY OF THE INVENTION

The invention generally concerns the Type II and Type III pin and sleeve devices referred to above. As used in this application, the term "receptacle" means the female half of a pin and sleeve device regardless of its means of support or connection to a power source (e.g., surface-mount, in-wall or panel mount, cable-connected, etc.).

Electrical receptacles according to the invention are for use with a standard plug having a shroud surrounding a plurality of pins and an external indexing tab on the shroud.

Such a receptacle comprises a housing having a longitudinal axis, an axially facing outer end and an axially extending cavity open to the outer end for receiving the shroud and the indexing tab of a plug. A releasable plug latch is carried by the housing and includes a catch movable transversely of the axis between a capture position and a release position and vice versa. The release position allows axial insertion and axial withdrawal of a plug and the capture position blocks withdrawal of a plug after at least partial insertion of the plug into the housing.

The receptacle also has a group of sleeve contacts and a group of inner contacts. The sleeve contacts extend axially into the housing from its outer end and are engageable through the outer end by respective pins of a plug. The inner contacts reside in the housing remote from the outer end. At least one of the groups of contacts is mounted for relative axial movement toward and away from the other group to enable the sleeve contacts axially to engage with and disengage from respective inner contacts.

Also included is a plug-activated interlock carried by the housing which includes at least one follower in the plug-receiving cavity displaceable by a plug during its axial insertion into the housing. The interlock keeps the sleeve contacts and the inner contacts disengaged when no plug is present in the housing, and enables engagement of those contacts during axial insertion of a plug into the housing only when the pins of the plug are substantially fully engaged with the sleeve contacts. Release of the plug latch disengages the sleeve contacts from the inner contacts and allows the plug to be removed from the receptacle.

The following features are combined in one embodiment. The sleeve contacts are held in a carrier that is movable relative to the fixed inner contacts. The catch is spring-loaded toward its capture position, free-floating and configured to be temporarily displaced by an incoming plug tab, after which it snaps back to its capture position behind the rear end of the tab. A pass-through ground conductor ensures that the primary circuit is grounded even before the sleeve contacts and the inner contacts are engaged. An LED circuit powered through the sleeve contacts and the inner contacts provides a visual indication of the status of the device. A modular clocking design having peripheral knockouts enables variable angular positioning of the inner contact support for a variety of configurations.

BRIEF DESCRIPTION OF THE DRAWINGS

Embodiments of the invention are described in detail below, purely by way of example, with reference to the accompanying drawing figures, in which:

FIG. 44 is an exploded perspective view of a Type III embodiment according to the invention shown with a standard male plug;

FIGS. 45-47 are rear detail views, partly in section, of the actuator portion of the receptacle of FIG. 44 in different states;

DETAILED DESCRIPTION OF THE INVENTION

As used in this application, terms such as "front," "rear," "side," "top," "bottom," "above," "below," "upwardly" and "downwardly" are intended to facilitate the description of the invention and are not to be construed as limiting the structure of the invention to any particular position or orientation.

Type II Embodiments

Common Features

Figure 1:
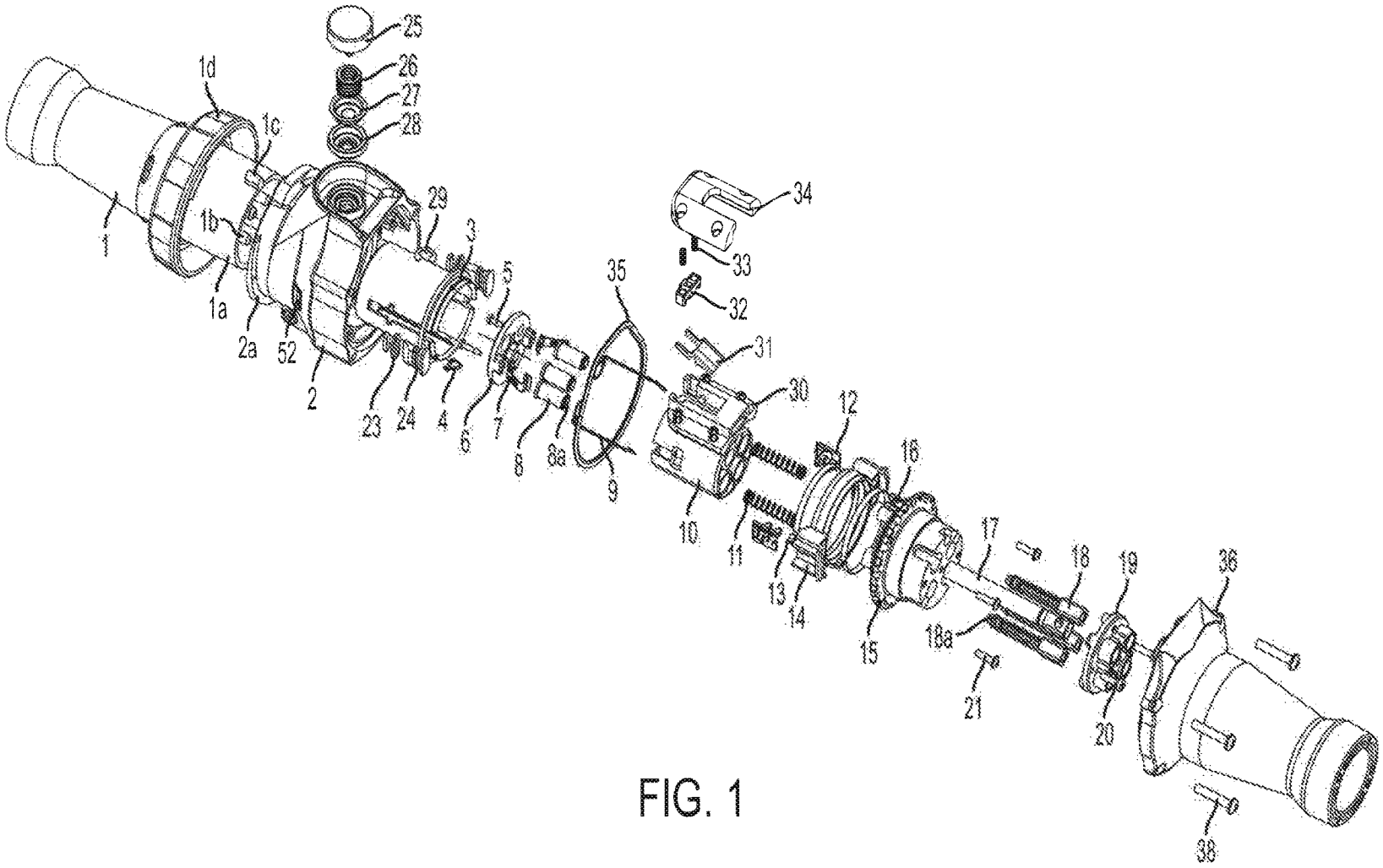
FIG. 1 is an exploded perspective view of a first receptacle embodiment according to the invention shown with a standard male plug.
Figure 2:
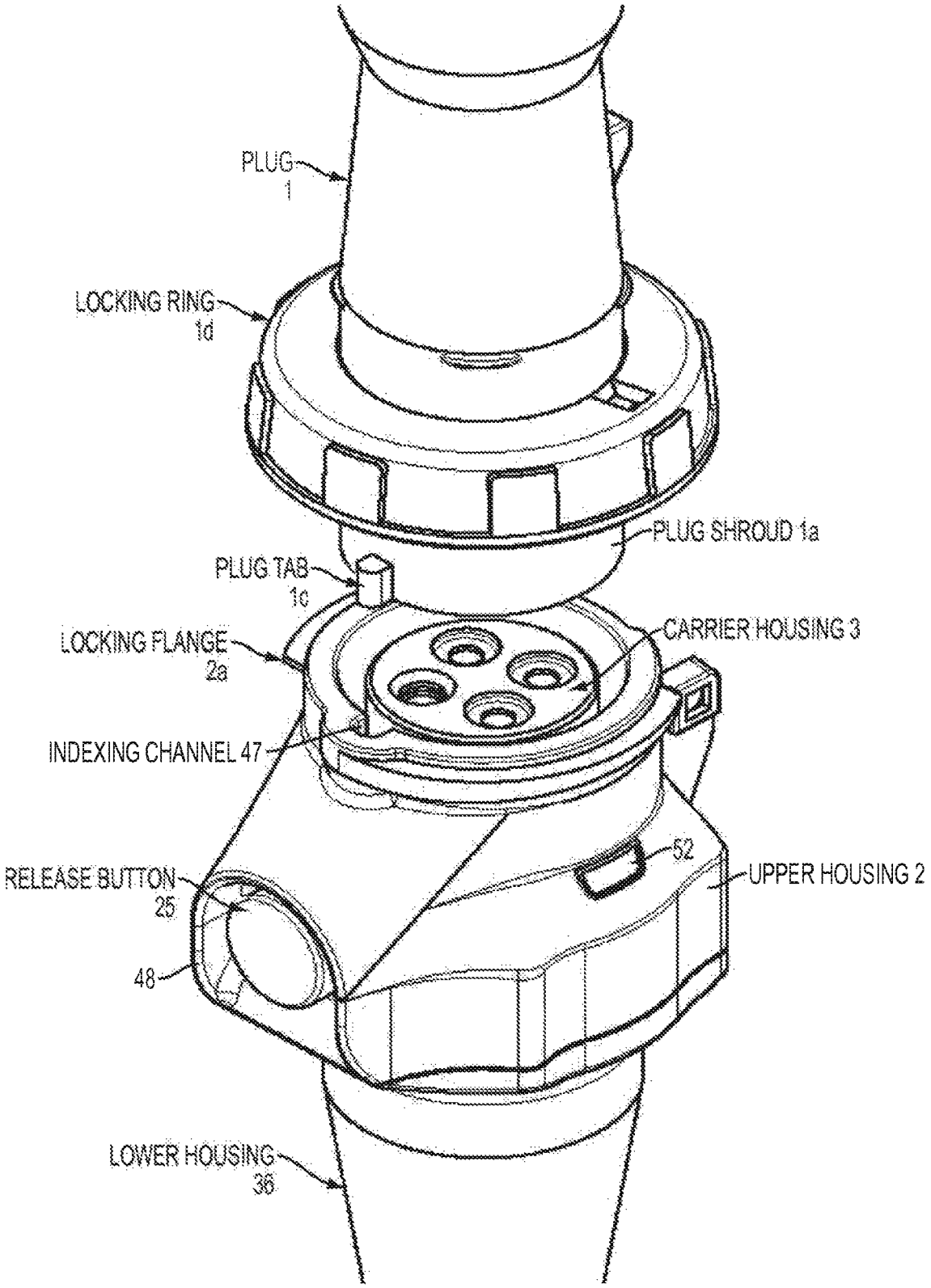
FIG. 2 is a perspective view of the assembled receptacle and plug of FIG. 1.
Figure 3:
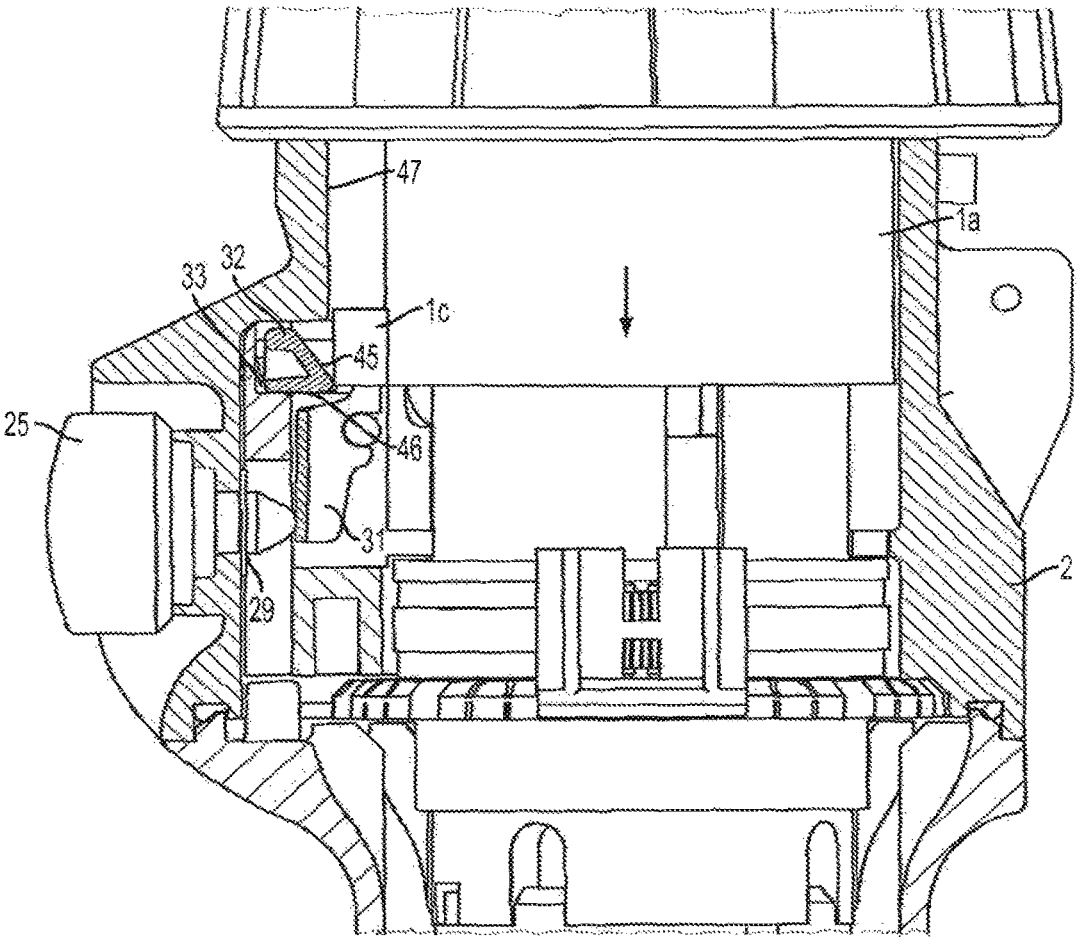
FIGS. 3 and 4 are longitudinal sectional views thereof showing the sequence of insertion of the plug into the receptacle of FIG. 1.
Figure 4:
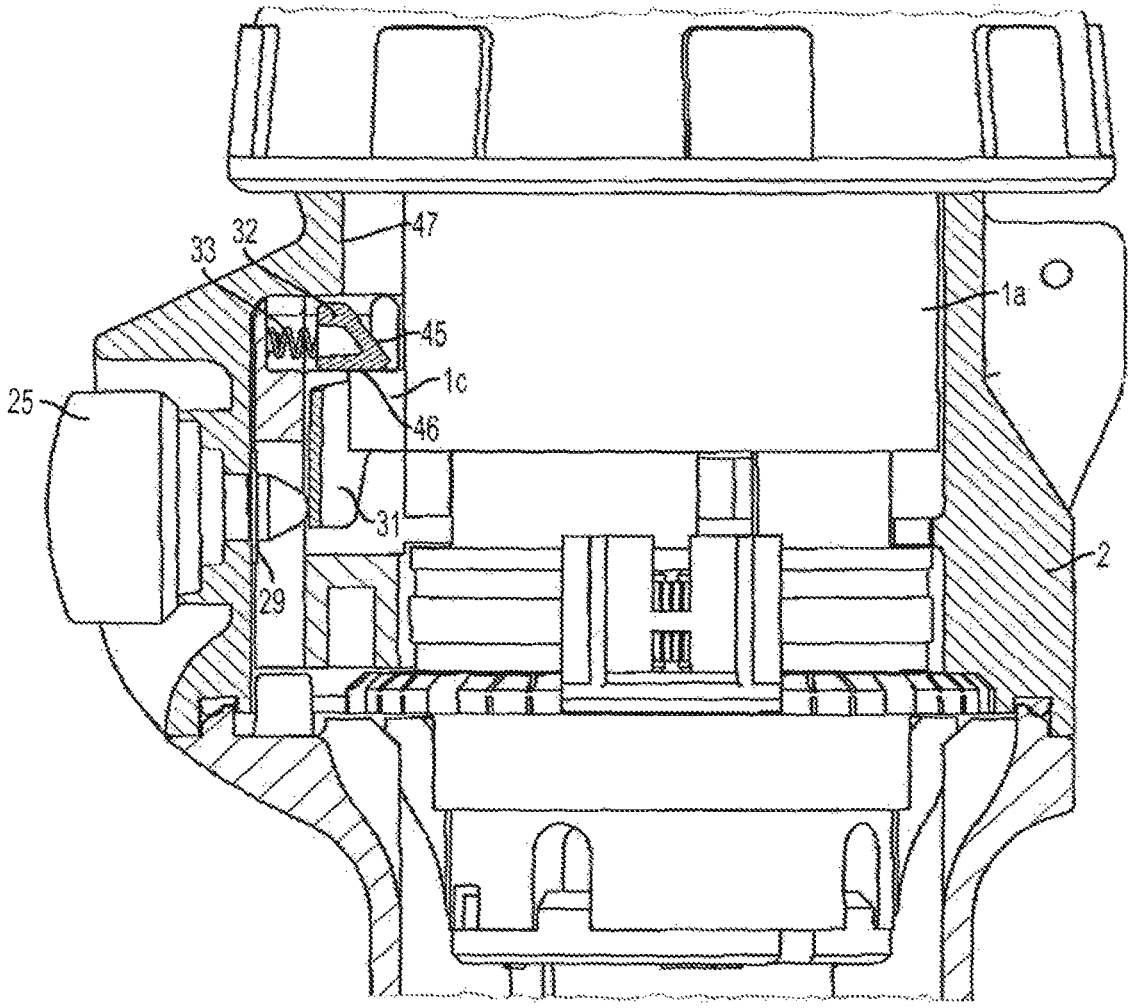

Reference is made by way of example to figures that show the first embodiment. The same reference numbers denote the same or similar items in figures that show the other embodiments. Referring to FIGS. 1 and 2, a standard male plug 1 for mating with receptacles according to the invention has a cylindrical front safety shroud 1*a* surrounding a plurality of contact pins 1*b* (four in the disclosed examples), which are adapted to mate respectively with four contact sleeves 8 ("sleeves" or "sleeve contacts") in the receptacle. The shroud has an integrally formed, radially projecting indexing rib or tab 1*e* at its front end (referred to in IEC 60309 as part of the "major keyway") and a rotatable locking ring 1*d* having two lugs (not shown) adapted to mate with two standard ramped locking flanges 2*a* at the front end of the receptacle's upper housing 2. A standard butted rubber gasket (not shown) seals the interface between the receptacle and the plug when they are fully mated. Each receptacle embodiment also has a lower housing 36 secured by screws 38 to its upper housing 2 with an interposed sealing gasket 35 (see FIG. 1). The lower housing 36 shown is configured for connection to a cable. Upper housing 2 of any embodiment can be mated instead to various adapters (not shown), using screws 38, to enable mounting of the receptacle on a surface, in a wall, in a panel, etc.

Figure 12:
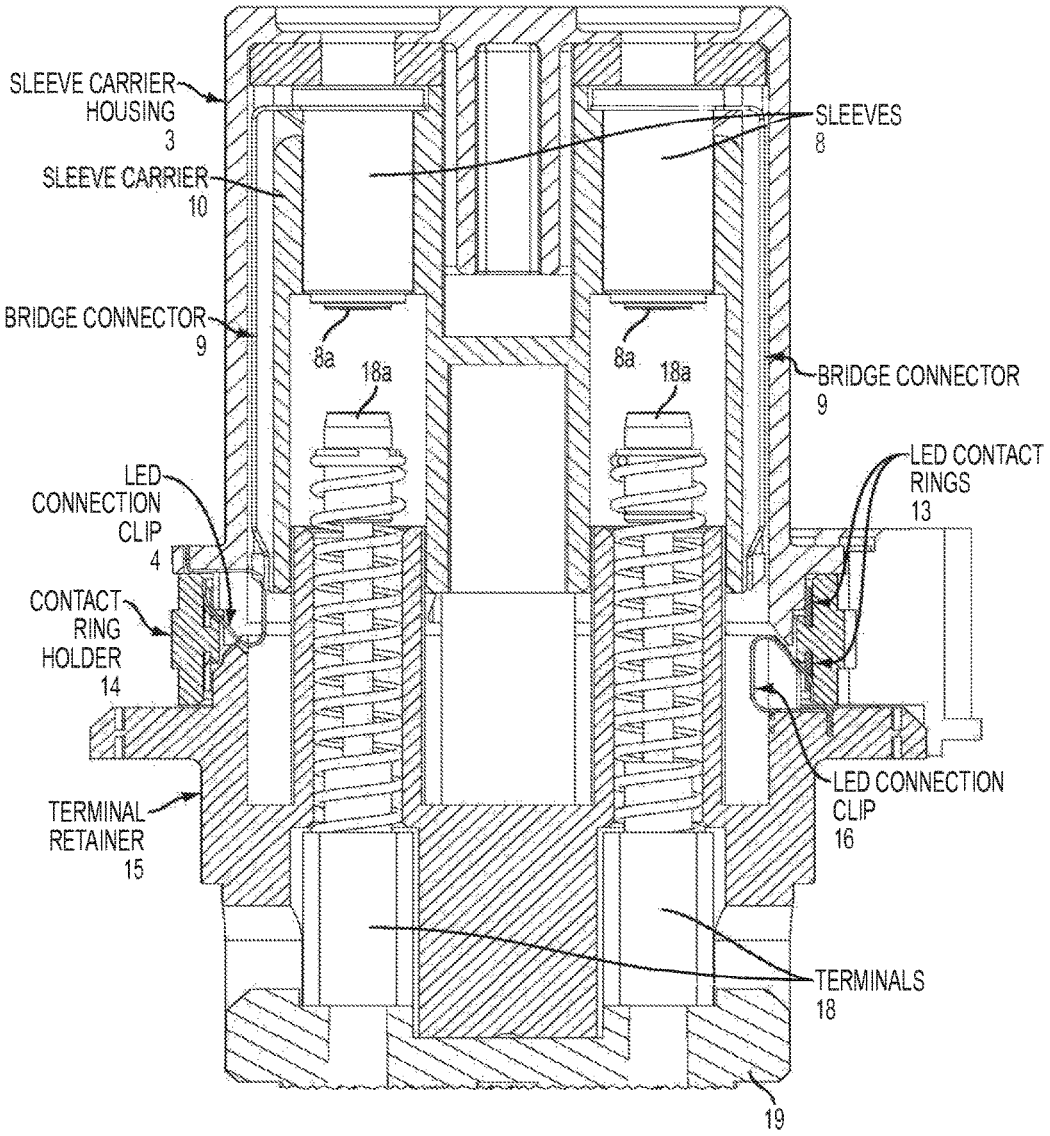
FIG. 12 is a longitudinal sectional view through the sleeve carrier housing, sleeve carrier and terminal retainer of the receptacle of FIG. 1 showing the sleeves separated from the pressure contacts.
Figure 13:
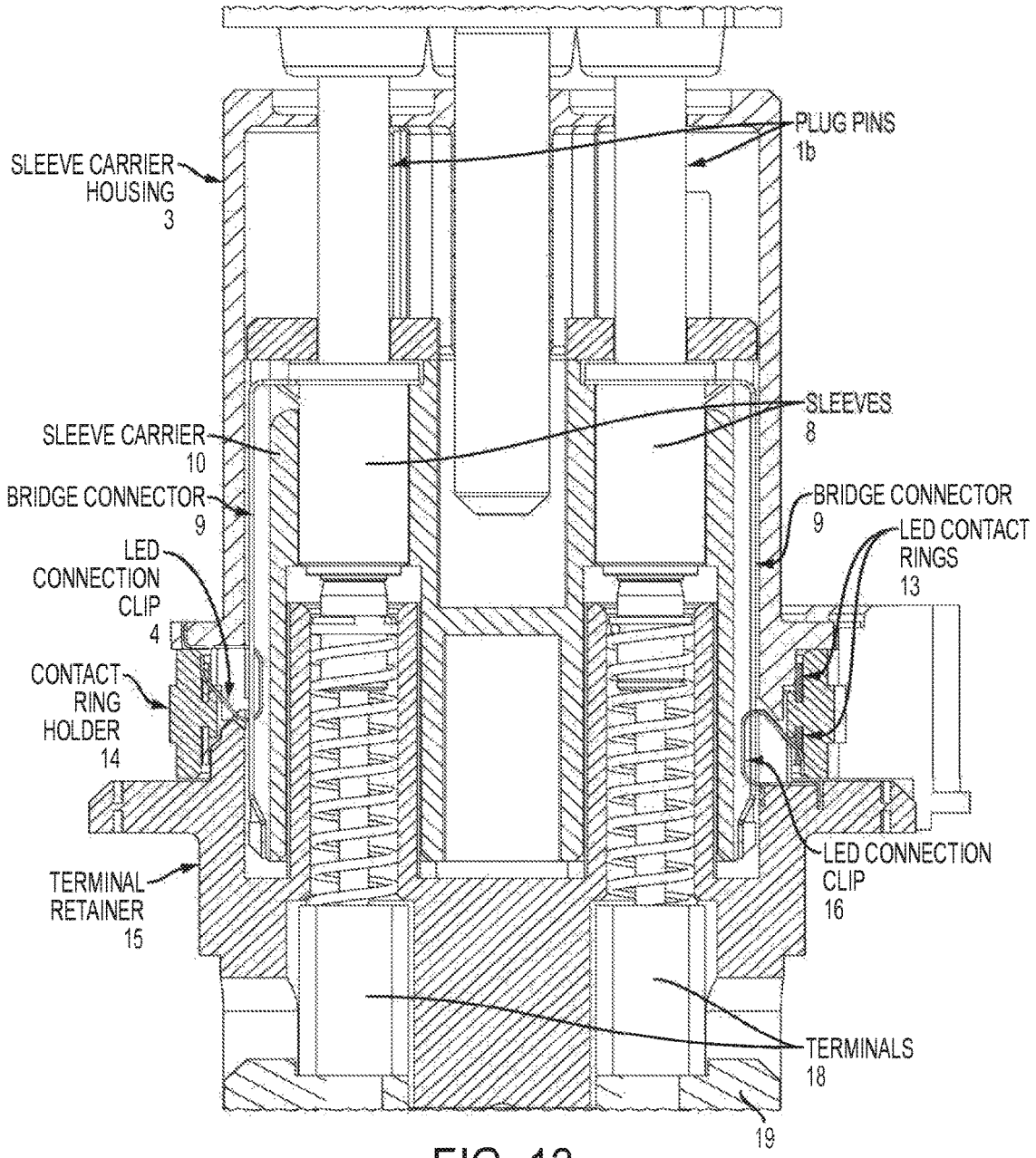
FIG. 13 is a longitudinal sectional view of the receptacle of FIG. 1 similar to FIG. 12 showing the sleeves engaging the pressure contacts.
Figure 14:
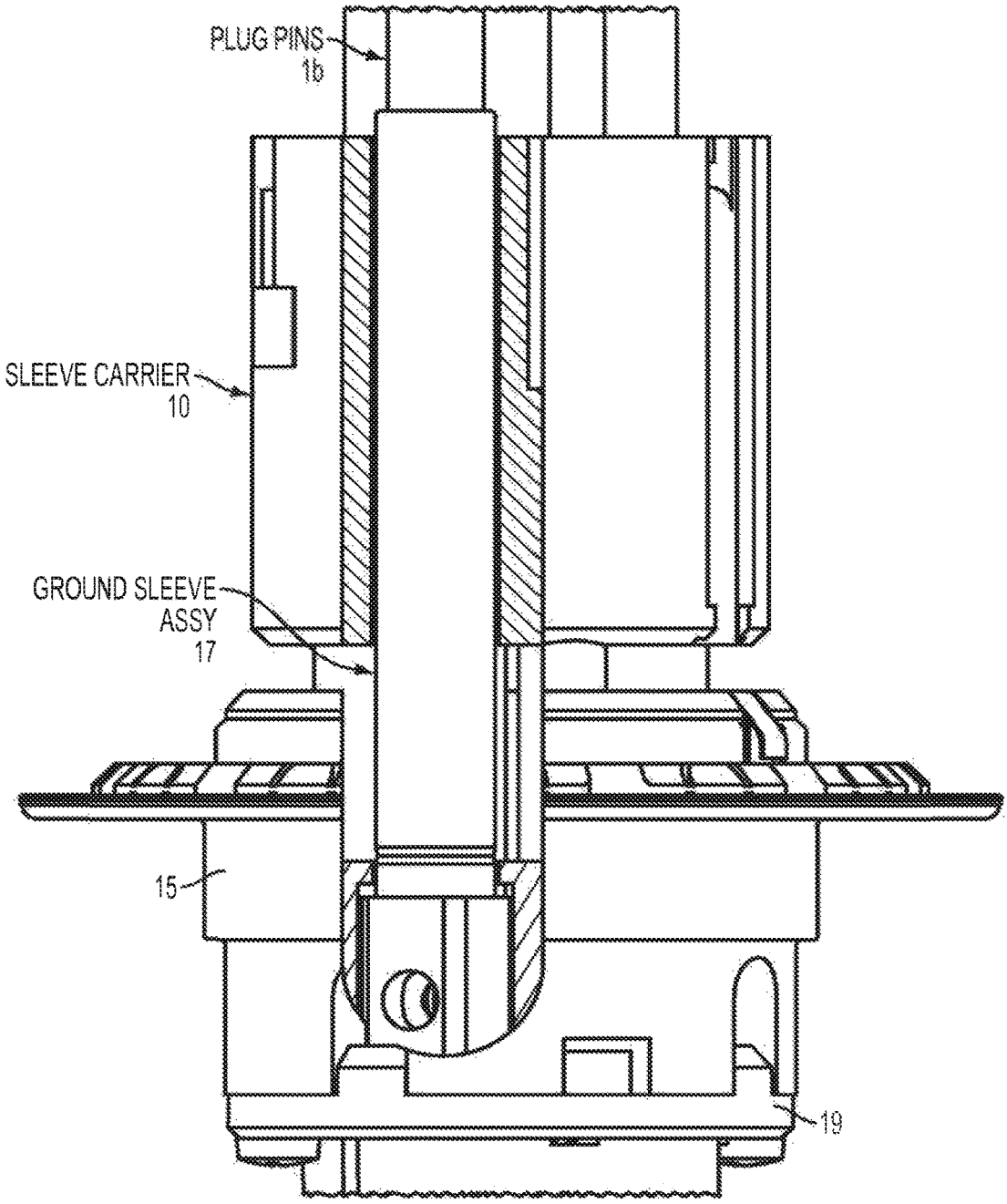
FIG. 14 is a side elevational view of the receptacle of FIG. 1 with parts removed showing details of the ground sleeve assembly.
Figure 15:
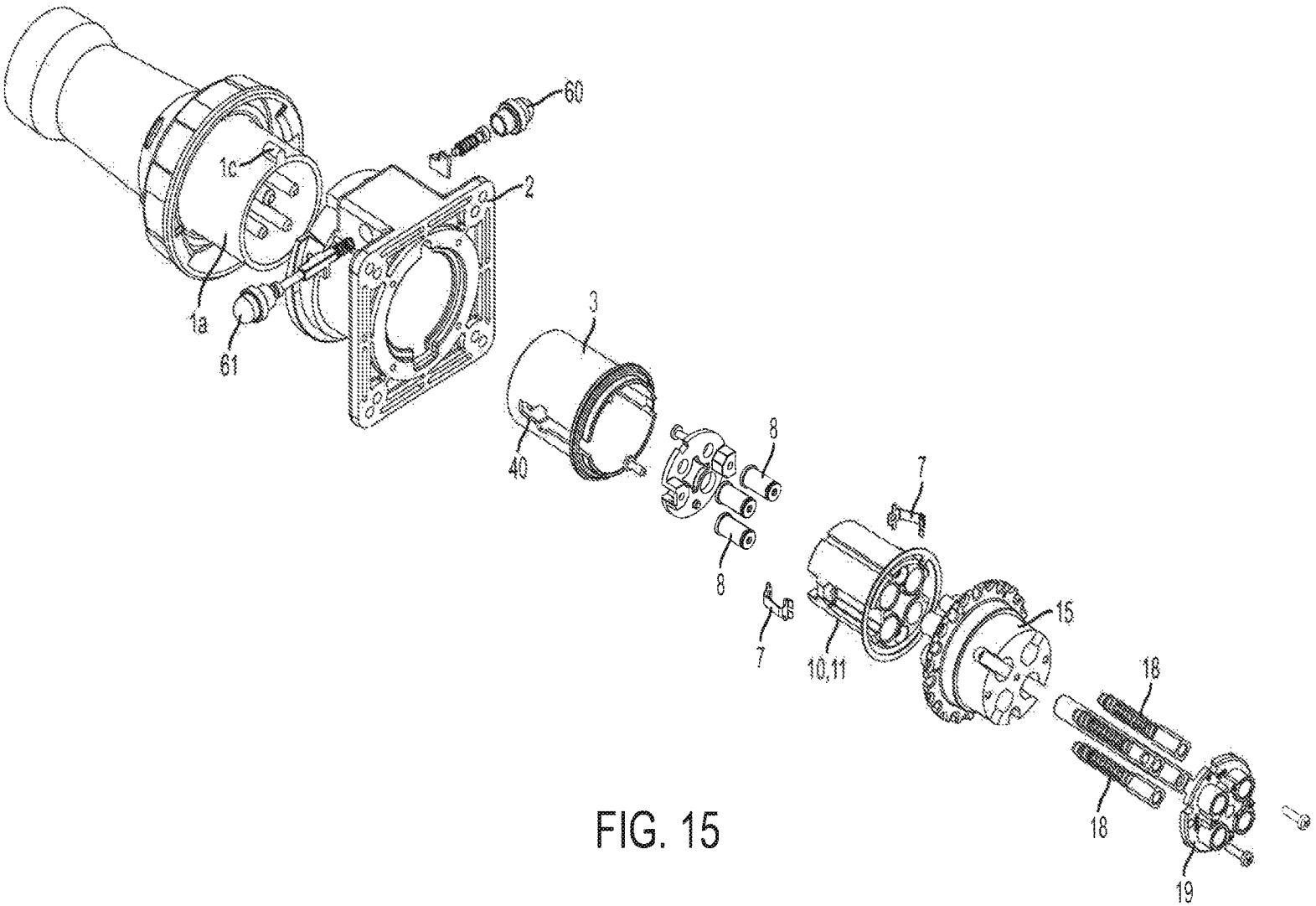
FIG. 15 is an exploded perspective view of a second receptacle embodiment according to the invention shown with a standard male plug.
Figure 17:
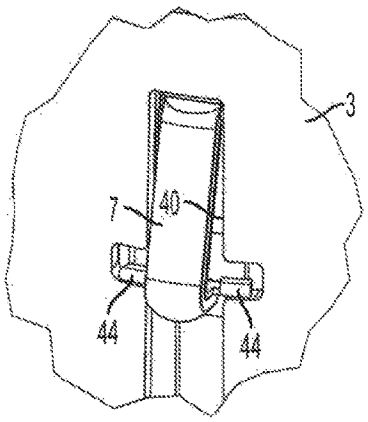
FIG. 17 is a detail perspective view of a retaining mechanism as seen in FIG. 16A.
Figure 16A:
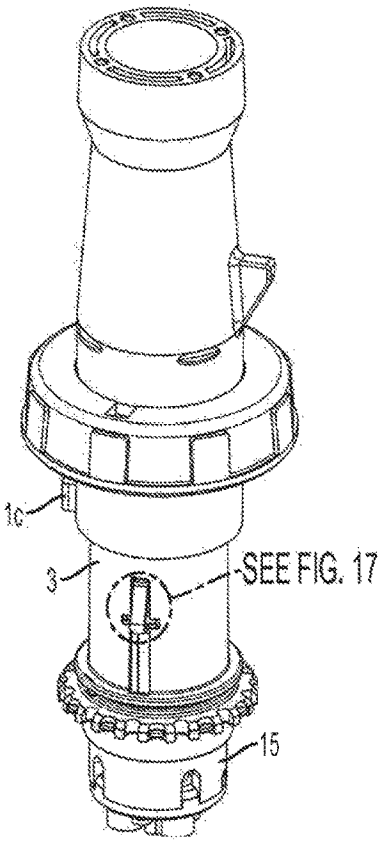
FIG. 16A is a perspective view of the partially engaged plug and receptacle of FIG. 15 with housing parts removed to reveal a retaining mechanism.
Figure 16:
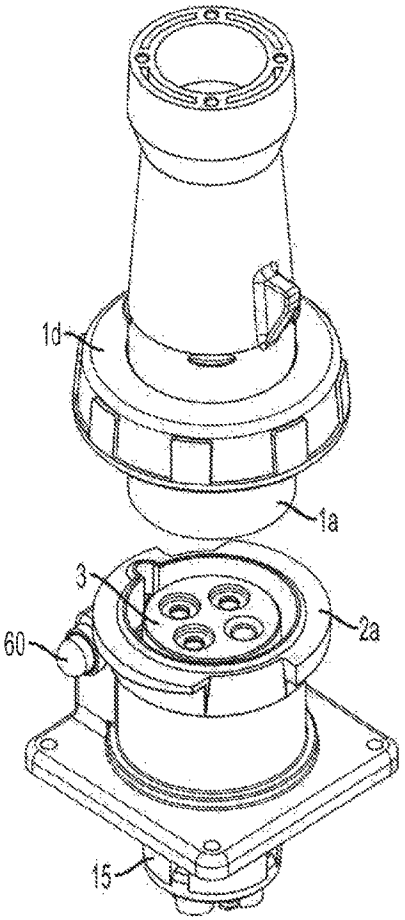
FIG. 16 is a perspective view of the assembled plug and receptacle of FIG. 15.
Figure 17A:
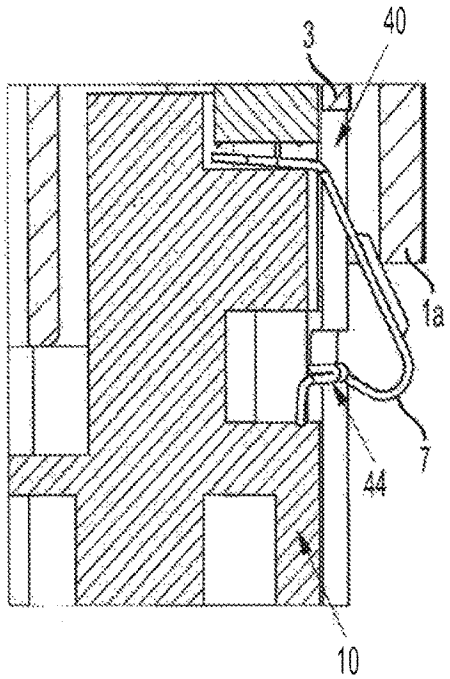
FIG. 17A is a longitudinal sectional view of the retaining mechanism as seen in FIG. 17.

Referring to FIGS. 1 and 12, three of the sleeves 8 (four in other embodiments) have inwardly facing silver tips 8*a* and are axially movable into and out of engagement respectively with the silver tips 18*a* of an equal number of braided, spring-loaded contact terminals 18 (hereinafter "pressure contacts" or "inner contacts"). Referring to FIGS. 1 and 10-13, the pressure contacts 18 are supported in a terminal retainer 15 by a terminal retainer cap 19 fastened to retainer 15 by screws 20. Terminal retainer 15 is fixed to housing 2 by screws 21. The pressure contacts are conventional: U.S. Pat. No. 4,176,905, which is incorporated by reference herein, shows a typical pressure contact of this type.

First Embodiment (FIGS. 1-14)

Figure 5:
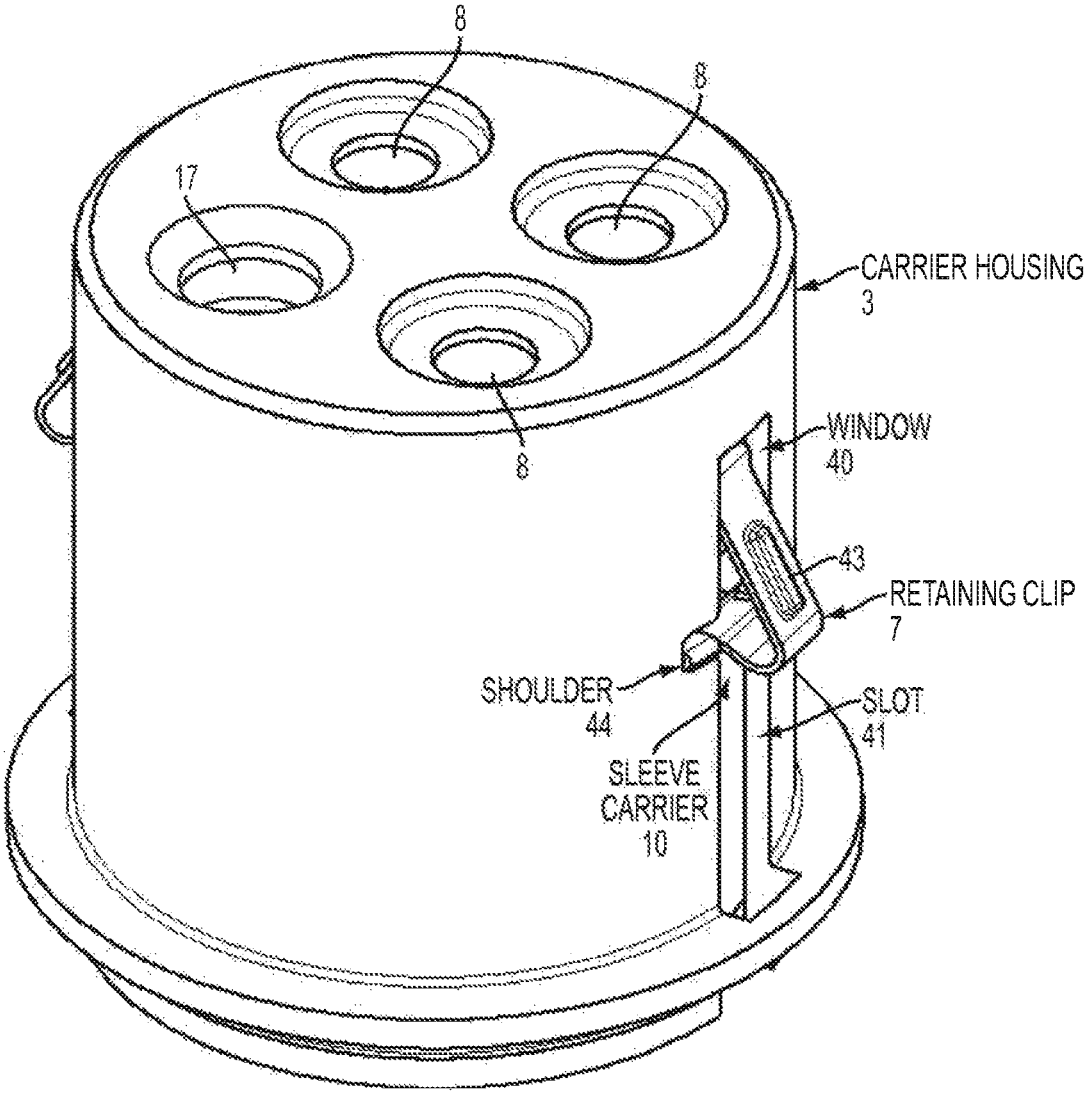
FIG. 5 is a perspective view of a retaining mechanism of the receptacle of FIG. 1.
Figure 6:
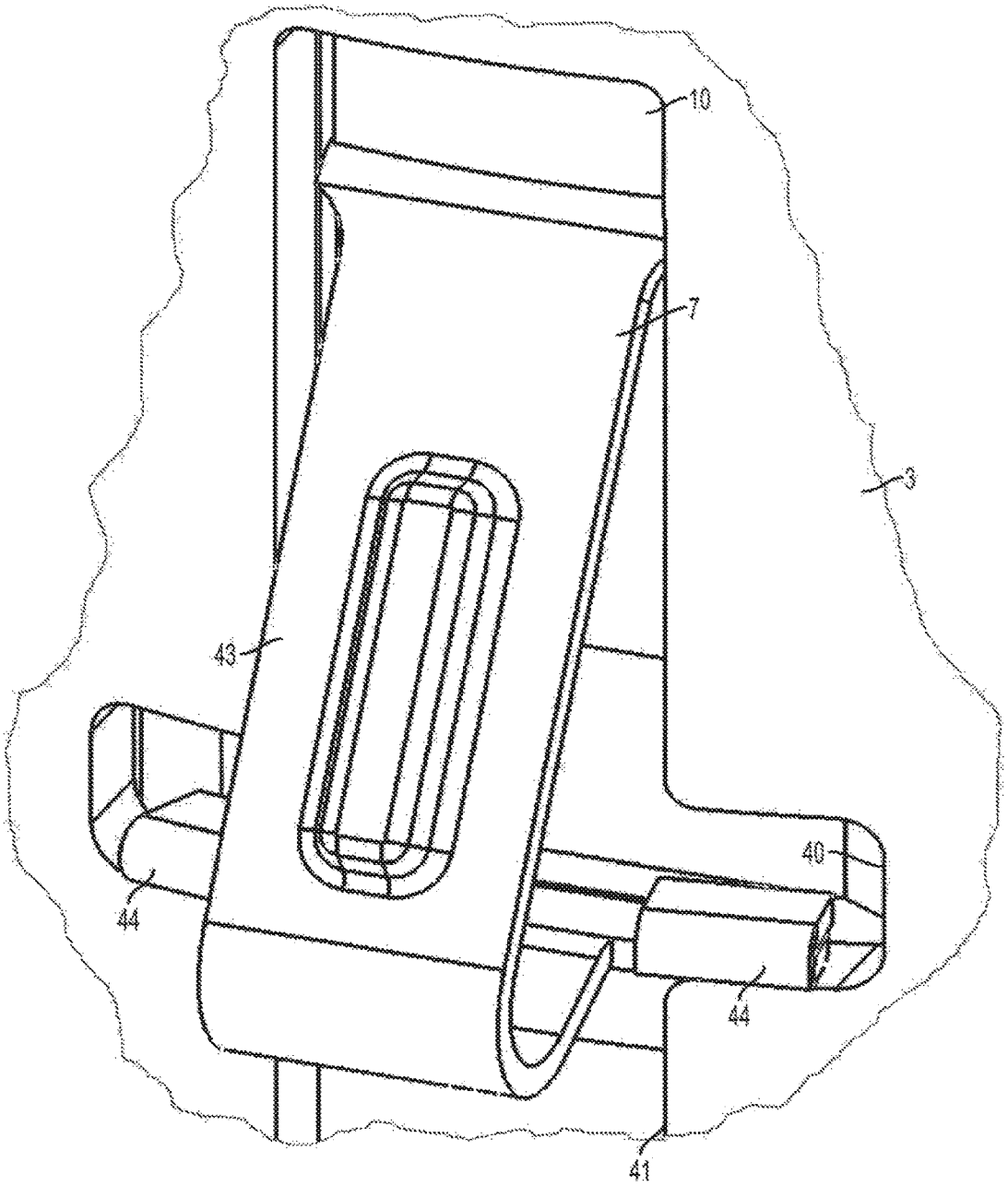
FIG. 6 is a detail perspective view of the retaining mechanism of FIG. 5.
Figure 7:
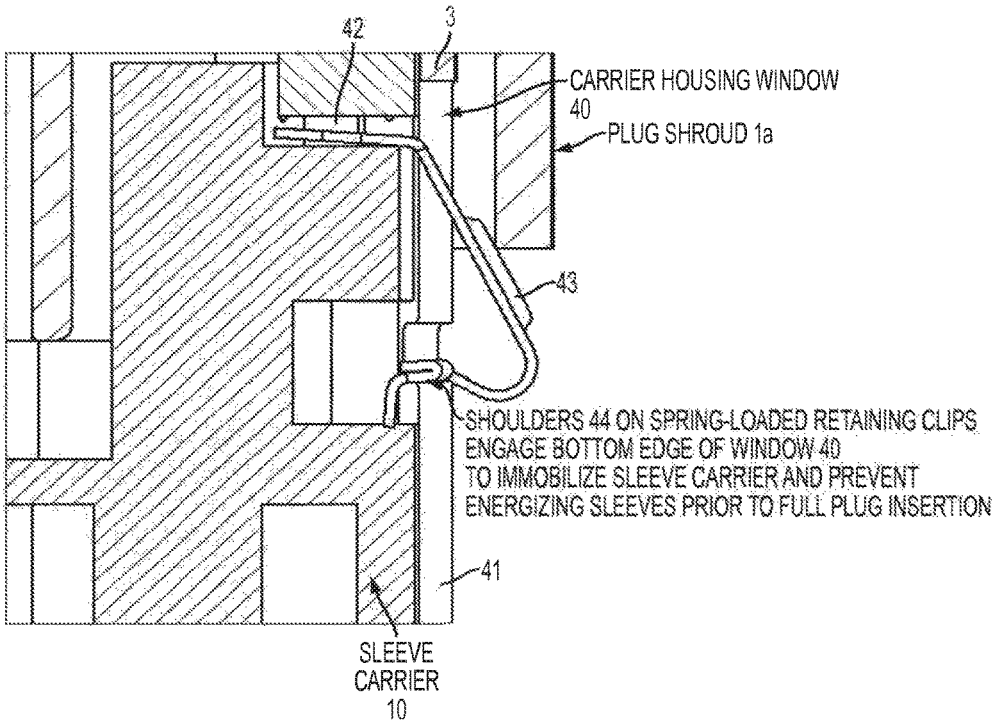
FIG. 7 is a detail sectional view of the retaining mechanism of FIG. 5.

Referring to FIGS. 1 and 12-14, the silver-tipped sleeves 8 of this embodiment are fixed in a sleeve carrier 10 by a sleeve carrier cap 6 held in place by screws 5. Sleeve carrier 10 is axially movable within a carrier housing 3. The carrier housing is fixed in place by the abutting terminal retainer 15 and its mounting screws 21. Two helical carriage springs 11 interposed between the sleeve carrier 10 and the terminal retainer 15 bias the sleeve carrier away from the pressure contacts 18. Referring to FIGS. 5-7, sleeve carrier 10 has two diametrically opposed windows 40 that join respective narrower longitudinal slots 41 extending toward the terminal retainer. Two inwardly deflectable, resilient retaining clips 7 are anchored near their upper ends in respective recesses 42 in the sleeve carrier (see FIG. 7). Each retaining clip 7 has an inclined, ribbed ramp portion 43 and a pair of lateral wings or shoulders 44. When the retaining clips are in a relaxed state (not deflected), their ramp portions 43 project outward through their respective windows 40 in the carrier housing and their shoulders 44 engage the lower edges of their respective windows, as shown in FIGS. 5-7. In this state, the retaining clips 7 prevent downward movement of the sleeve carrier 10, keeping the sleeves 8 separated from the pressure contacts 18; and they project into the path traveled by a plug shroud 1*a*.

Referring to FIGS. 1-4, the upper housing 2 carries a latching mechanism that interacts with the male plug's indexing rib (tab) 1*e* during coupling and uncoupling. The latching mechanism controls relative movement of the mating parts and provides positive and audible engagement of the mating plug. The latching mechanism includes a latch housing 30 and a latch housing cover 34 that house a "floating" latch or catch 32 biased inwardly by springs 33 toward a latched or plug-capture position. In the capture position (see FIG. 4) the catch projects into an indexing channel 47 (the other part of the IEC 60309 "major keyway") in which the plug tab 1*e* travels. Catch 32 has a beveled leading surface (ramp) 45 and a flat trailing surface (shoulder) 46. When pressed, a spring-loaded pushbutton (25, 26) acts against the lower end of a forked, medially pivoted toggle release lever 31 in latch housing 30 to pull catch 32 back, away from its capture position. A retaining ring 29 keeps the pushbutton assembly from dislodging from the housing.

The pushbutton assembly is sealed to the housing by a button seal cup 27 and a button lip seal 28 and is surrounded on three sides by a U-shaped rim 48 integrally formed with the upper housing 2. Rim 48 protects the pushbutton assembly from damage yet provides sufficient space in the recess around the pushbutton to keep dust and debris from accumulating in that region. That feature and the sleek and watertight nature of the housing should qualify such a receptacle as a NEMA 4X type enclosure, making it well-suited for use in the food service industry and in other applications where moisture and particulates are present.

Complete mechanical and electrical coupling of a plug and the receptacle is accomplished by simple axial plug insertion, which triggers a sequence of movements of the internal parts. Initial plug insertion yields mechanical coupling only. The pins of the plug are mated with and pressed into the respective sleeves of the receptacle, but the sleeves 8 and their carrier 10 are held fast by the retaining clips 7 even as the leading edge (rim) of the plug shroud 1*a* starts to deflect them radially inward (see FIG. 7). When the plug pins are substantially fully seated in the sleeves 8 the retaining clips 7, which act as followers, have been deflected by the plug rim to the point that their shoulders 44 have cleared the edges of the windows in the carrier housing 3, freeing the carrier 10 to move downward.

Further insertion of the plug pushes the carrier 10 and its sleeves 8 toward the pressure contacts 18, compressing the carriage return springs 11. As this occurs, the plug tab 1*e* contacts the ramp 45 of catch 32, displacing the catch until it audibly snaps back behind the plug tab with its trailing shoulder 46 confronting the trailing end of the plug tab (see FIGS. 3 and 4) to keep the plug and the receptacle fully mated and to block plug withdrawal until the catch is manually released. In this state, the pins are fully seated in the sleeves and the sleeves are in electrical contact with the tips of the pressure contacts, providing power to the plug and the primary electrical circuit.

Figure 8:
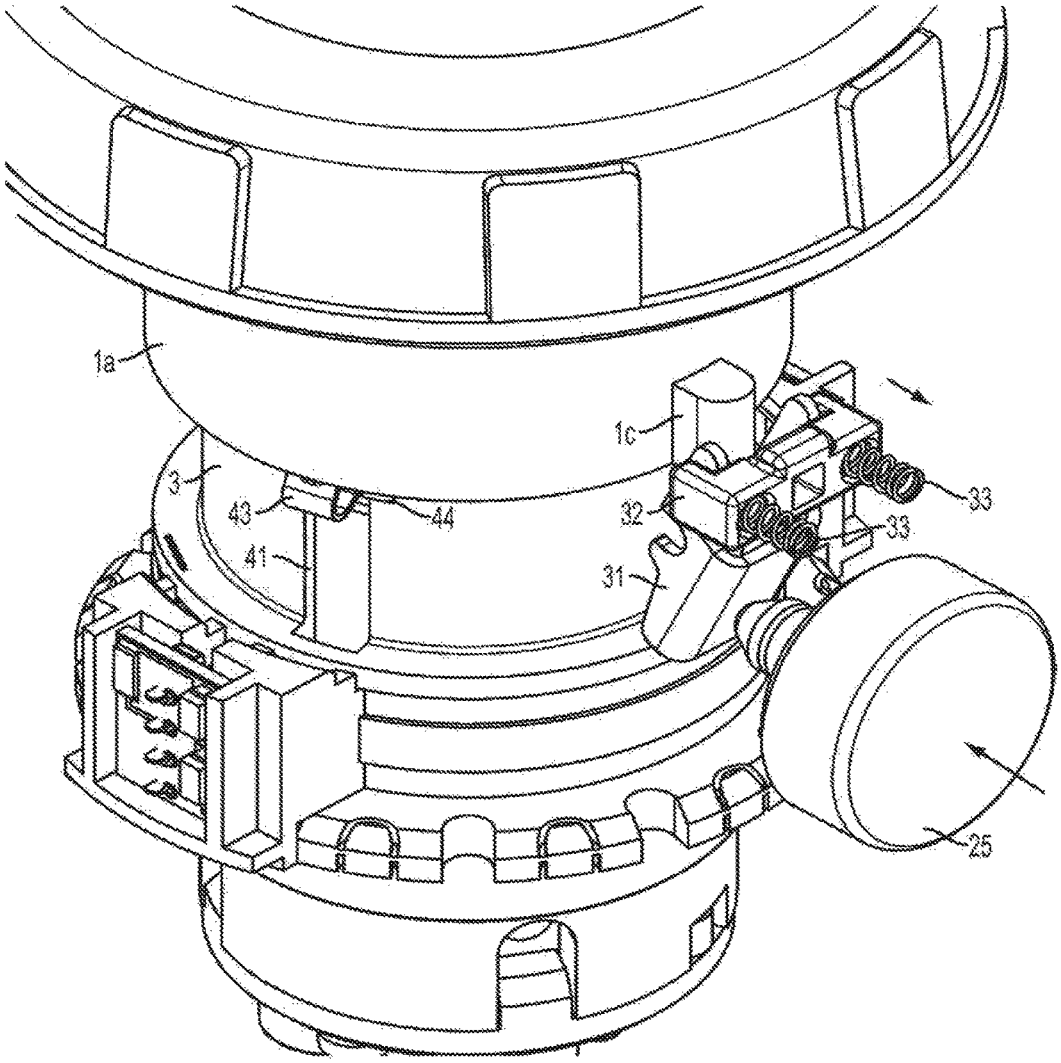
FIG. 8 is a perspective view of the receptacle and plug of FIG. 1 with parts removed showing the sequence of removal of the plug from the receptacle.
Figure 9:
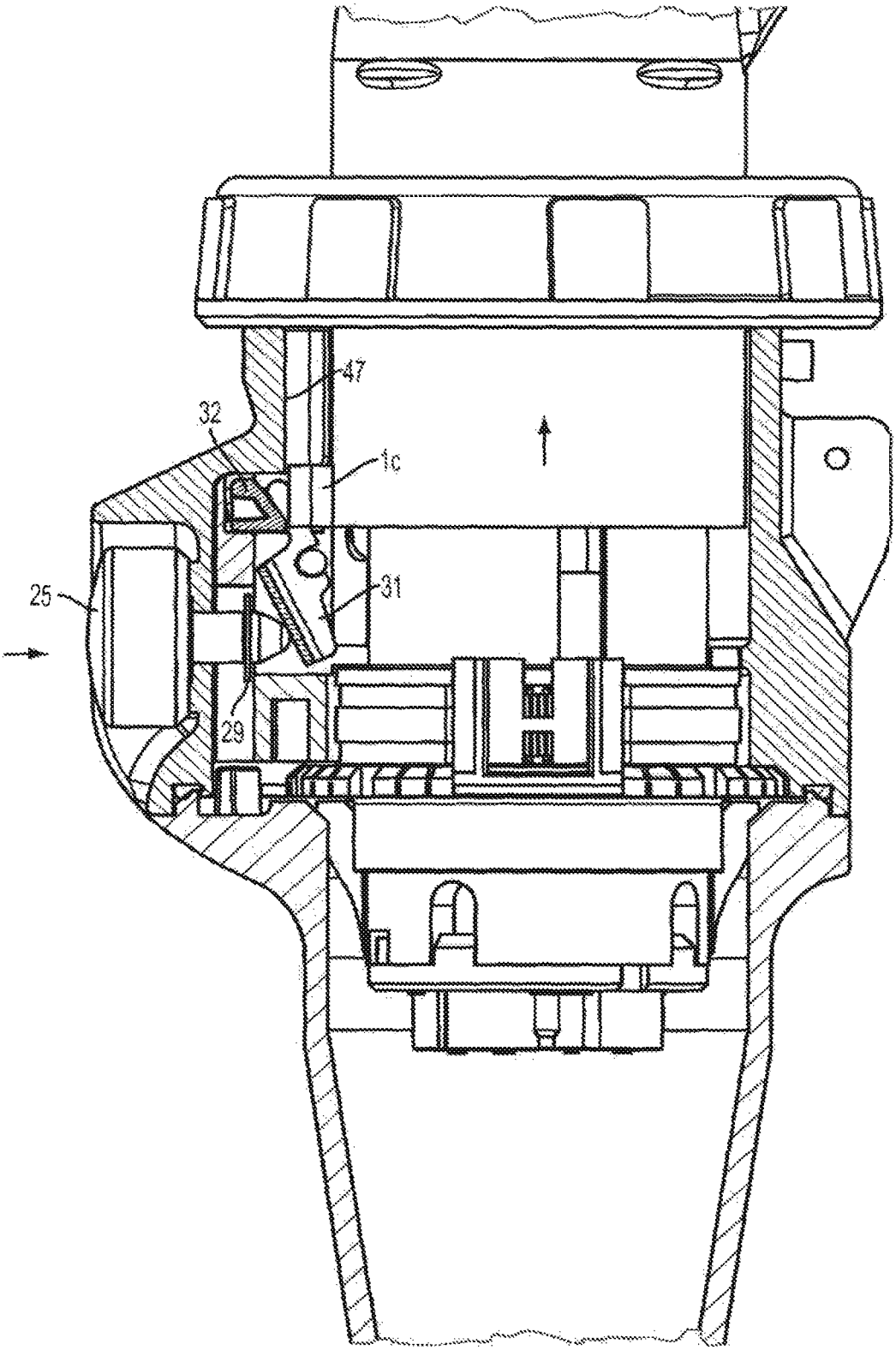
FIG. 9 is a longitudinal sectional view of the receptacle and plug of FIG. 1 showing the sequence of plug removal.

The plug unlatching and removal sequence is illustrated in FIGS. 8 and 9. To remove the plug, the release (disconnect) pushbutton 25 is pressed to release the catch 32, which then allows the return springs 11 to retract the sleeve carrier 10. This action separates the sleeves 8 from the pressure contacts 18 and at least partially ejects the plug, allowing complete plug withdrawal. In the event the sleeves and the pressure contacts weld while energized, they can be separated safely by holding the latch pushbutton in its released state and pulling the plug and the receptacle apart.

Figure 10:
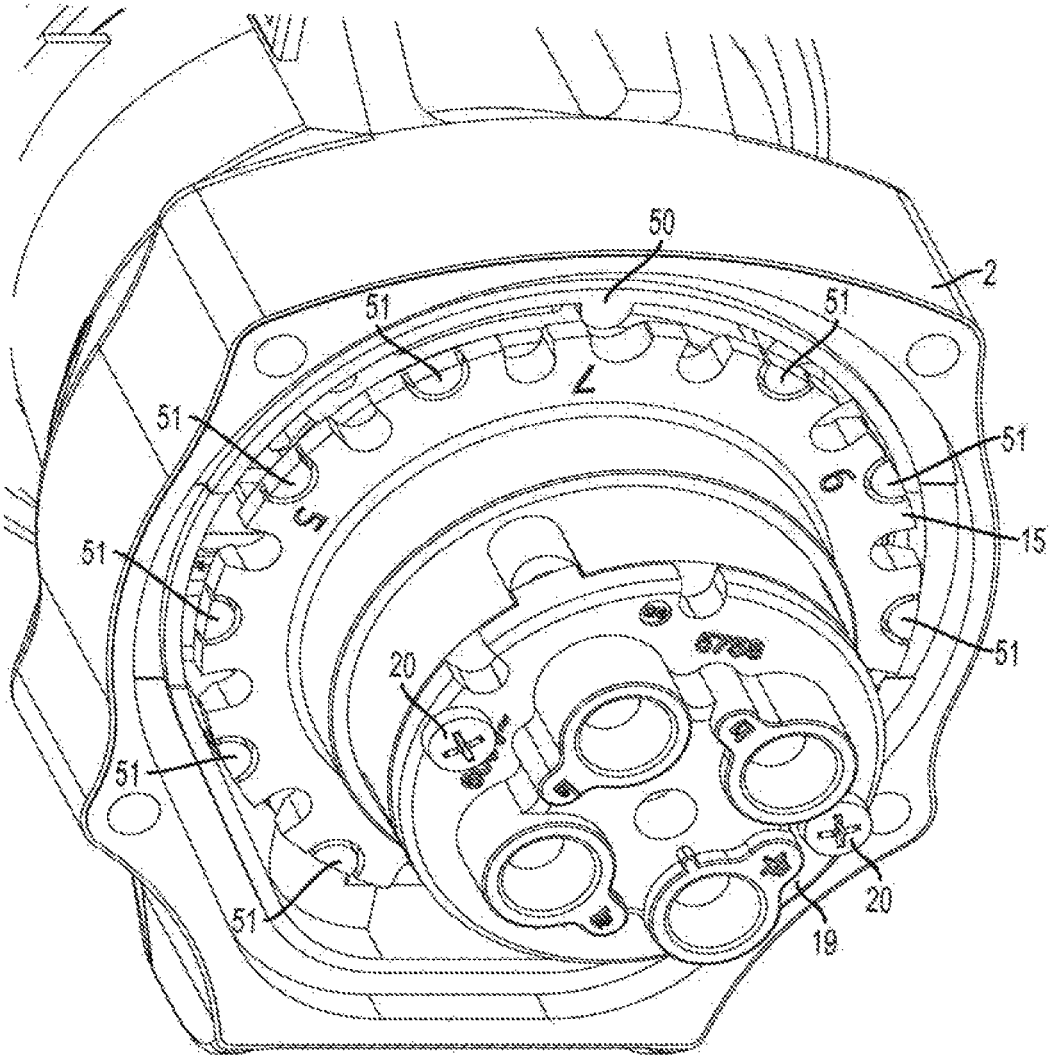
FIG. 10 is a bottom perspective view of the terminal retainer in the upper housing of the receptacle of FIG. 1.
Figure 11:
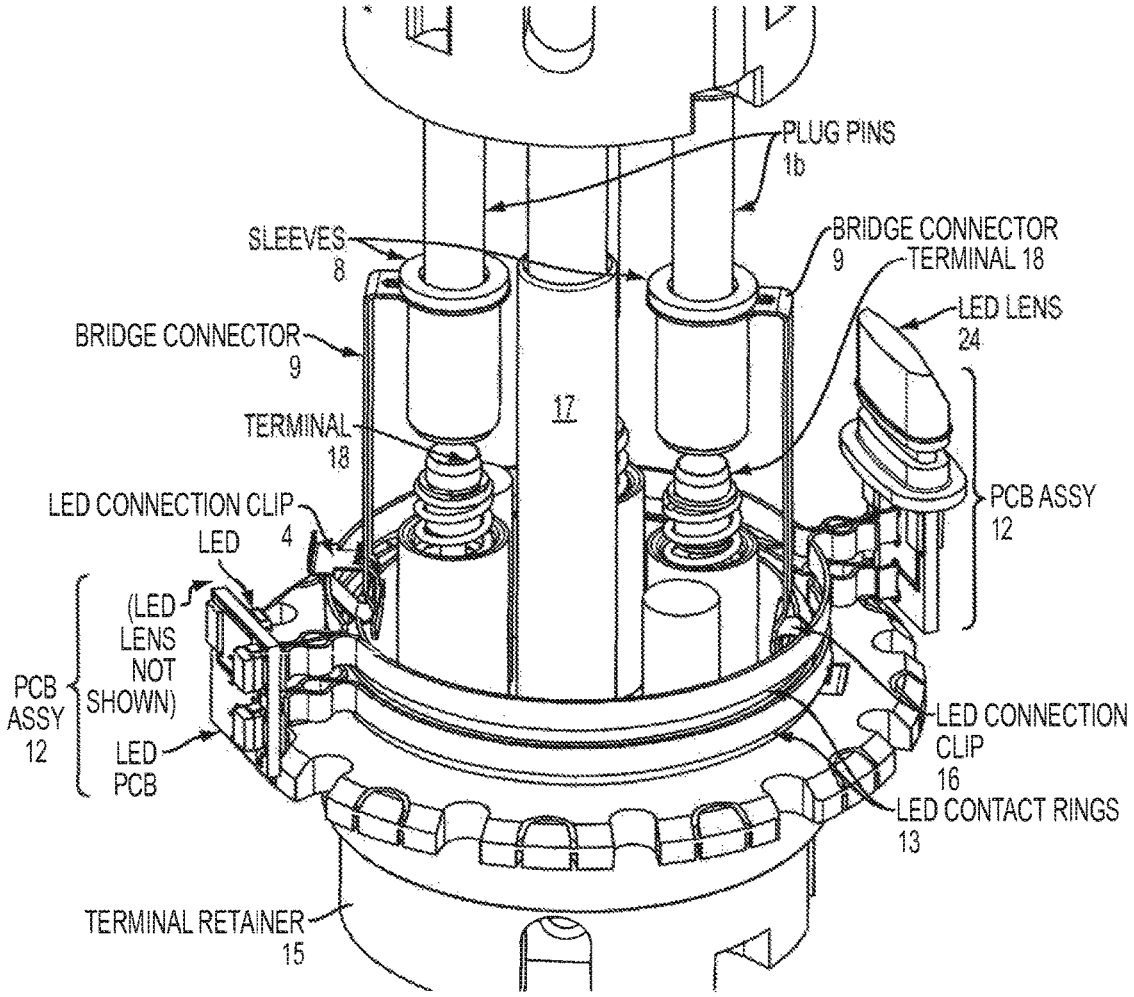
FIG. 11 is a perspective view of the receptacle and plug of FIG. 1 with parts removed showing the status indicator circuit.

This embodiment features a modular clocking design that enables variable angular positioning of the terminal retainer 15 so that a variety of terminal (pressure contact) configurations can be achieved during receptacle manufacture without having to stock differently configured terminal retainers. Referring to FIG. 10, upper housing 2 has a clocking key 50 facing the periphery of terminal retainer 15, which has a plurality of peripheral clocking knockouts 51. The appropriate knockout 51 is broken out during receptacle assembly depending on the terminal configuration specified for the unit. This modular clocking feature is suitable for use in any of the type II embodiments disclosed herein.

This embodiment also features a continuous ground design that ensures grounding of the primary electrical circuit throughout plug insertion and withdrawal. Referring to FIGS. 1, 5, 11 and 14, one of the sleeves is in the form of a pass-through ground sleeve assembly 17 that, unlike sleeves 8, is not supported in or moved by sleeve carrier 10 and has no silver tip on its inner end. Instead, the ground sleeve assembly 17 is fixed in terminal retainer 15 and extends freely through sleeve carrier 10 where its distal (outer) begins to mate with a plug's ground pin upon initial plug insertion before the other sleeves are engaged by their respective plug pins. Upon plug withdrawal, the ground sleeve assembly is the last sleeve to disengage from its respective plug pin. Thus, the sleeve carrier moves along the fixed ground sleeve assembly the ground connection does rely on a pressure contact. This continuous ground feature is suitable for use in any of the embodiments disclosed herein.

This embodiment also features a plug/receptacle status indicator using the primary circuit to power a low-current lighting control circuit. Referring to FIGS. 1 and 11-14, two bridge connectors 9 transmit current from two line sleeves 8 through top (4) and bottom (16) connection clips to respective top and bottom cylindrical contact rings 13 (each ring has two halves). Those rings are held in place on terminal retainer 15 by a contact ring holder 14. Two plug-in printed circuit board (PCB) assemblies 12 with integral LEDs or other lighting elements and lighting circuits are connected to and supported by the contact rings, and each supports an LED lens 24 and an interposed lens gasket 23. Closure of the primary electrical circuit upon full plug engagement with the receptacle also closes the lighting control circuit, energizing the LED lamps. The illuminated LED lamps are visible through observation windows 52 on opposite sides of upper housing 2 (see FIGS. 1 and 2), providing a visual indication that power has been supplied to the plug. This status indicator feature is suitable for use in any of the Type II embodiments disclosed herein.

Second Embodiment (FIGS. 15-19C)

The embodiment of FIGS. 15-19C has essentially the same components as the first embodiment, except for differences in the plug latching arrangement. In this second embodiment, the receptacle upper housing has two latches 60, 61 instead of one, and they act tangentially rather than radially. Each latch of this embodiment similarly is spring-biased toward a latched position and has a beveled leading surface (ramp) 62 and a flat trailing surface (shoulder) 63. Each also has a release shaft and an external release button, which when pressed moves the shaft and its latch against the spring force away from a capture position. During plug insertion (see FIGS. 16A-18E) the retaining clips function in the same way to temporarily hold the sleeves back from the pressure contacts, but the two-latch design provides an intermediate retaining position. As a result, complete mechanical and electrical coupling of the plug and the receptacle is accomplished in two stages through seamless, strictly axial translation.

Figure 18B:
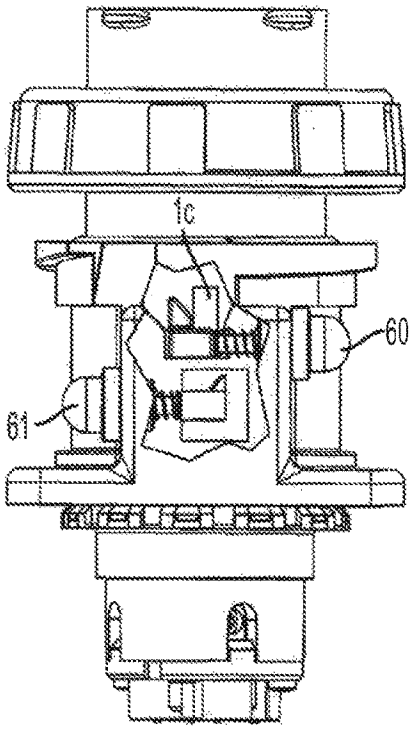
FIGS. 18A-18E are detail views of portions of the receptacle of FIG. 15 showing the sequence of insertion of the plug into the receptacle.
Figure 18A:
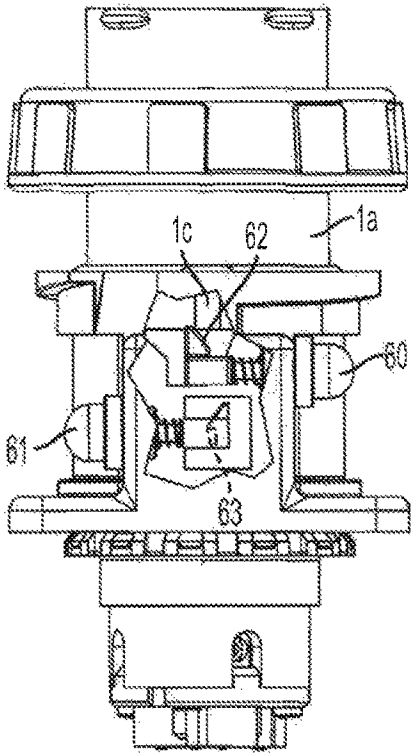
Figure 18E:
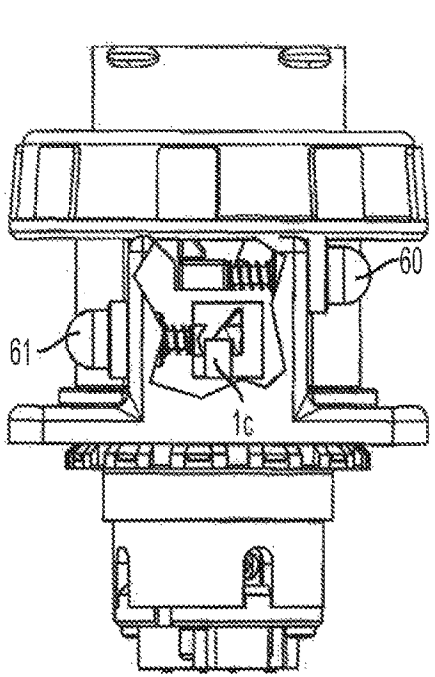
Figure 18D:
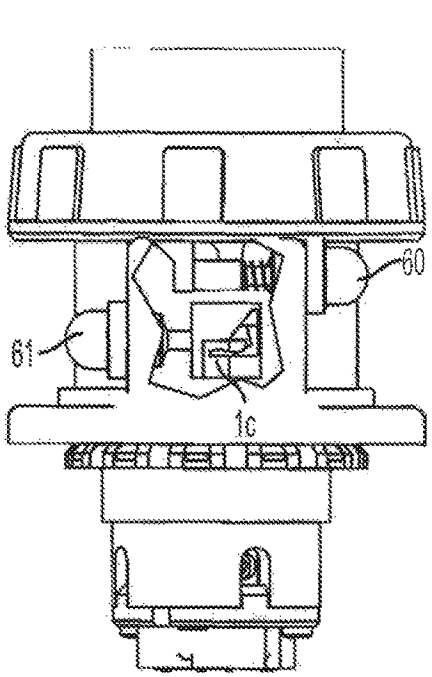
Figure 18C:
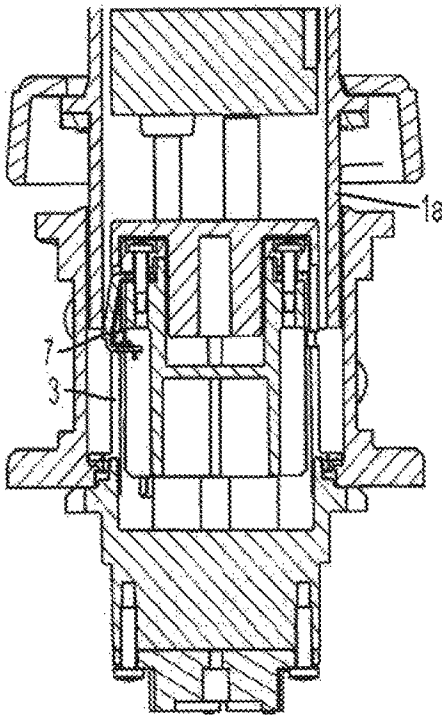

The first stage involves mechanical coupling only. On initial plug insertion, the plug becomes parked and retained after passing the first latch 60, and the retaining clips 7 continue to immobilize the sleeves to prevent them from energizing. The second stage involves electrical coupling to energize the sleeves and the mated plug pins. Specifically, further insertion of the plug deflects the retaining clips 7 (see FIG. 18C), freeing the carrier housing 10 to move downward until the fully seated plug pins are energized through the fully displaced and energized sleeves. The second stage is concluded when the second latch 61 springs back to capture the plug tab 1*c* and the receptacle is fully mated (FIG. 18E).

Figure 19C:
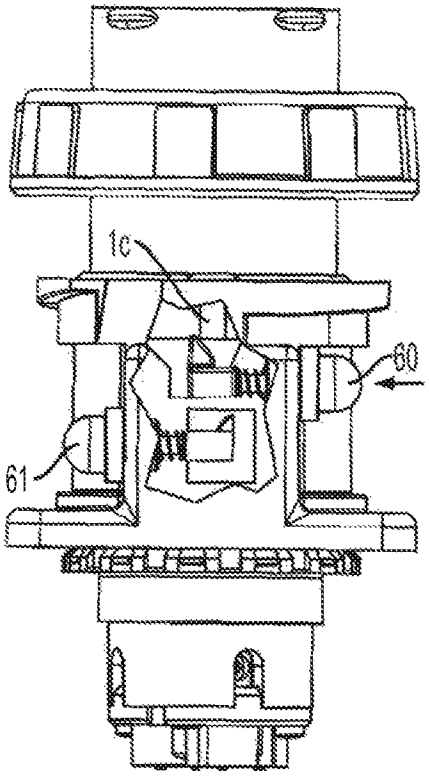
FIGS. 19A-19C are detail views of portions of the receptacle of FIG. 15 showing the sequence of removal of the plug from the receptacle.
Figure 19B:
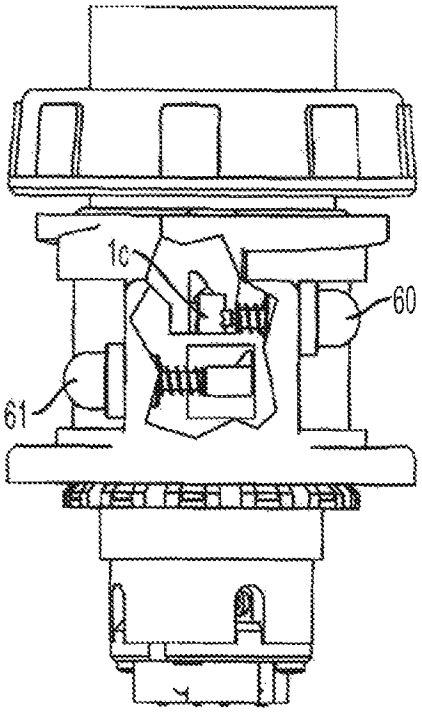
Figure 19A:
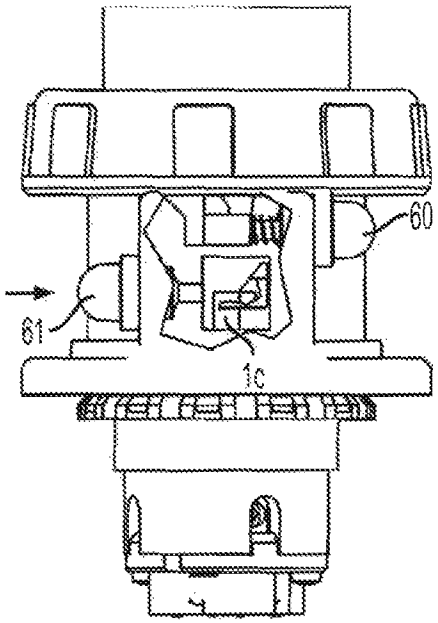
Figure 20:
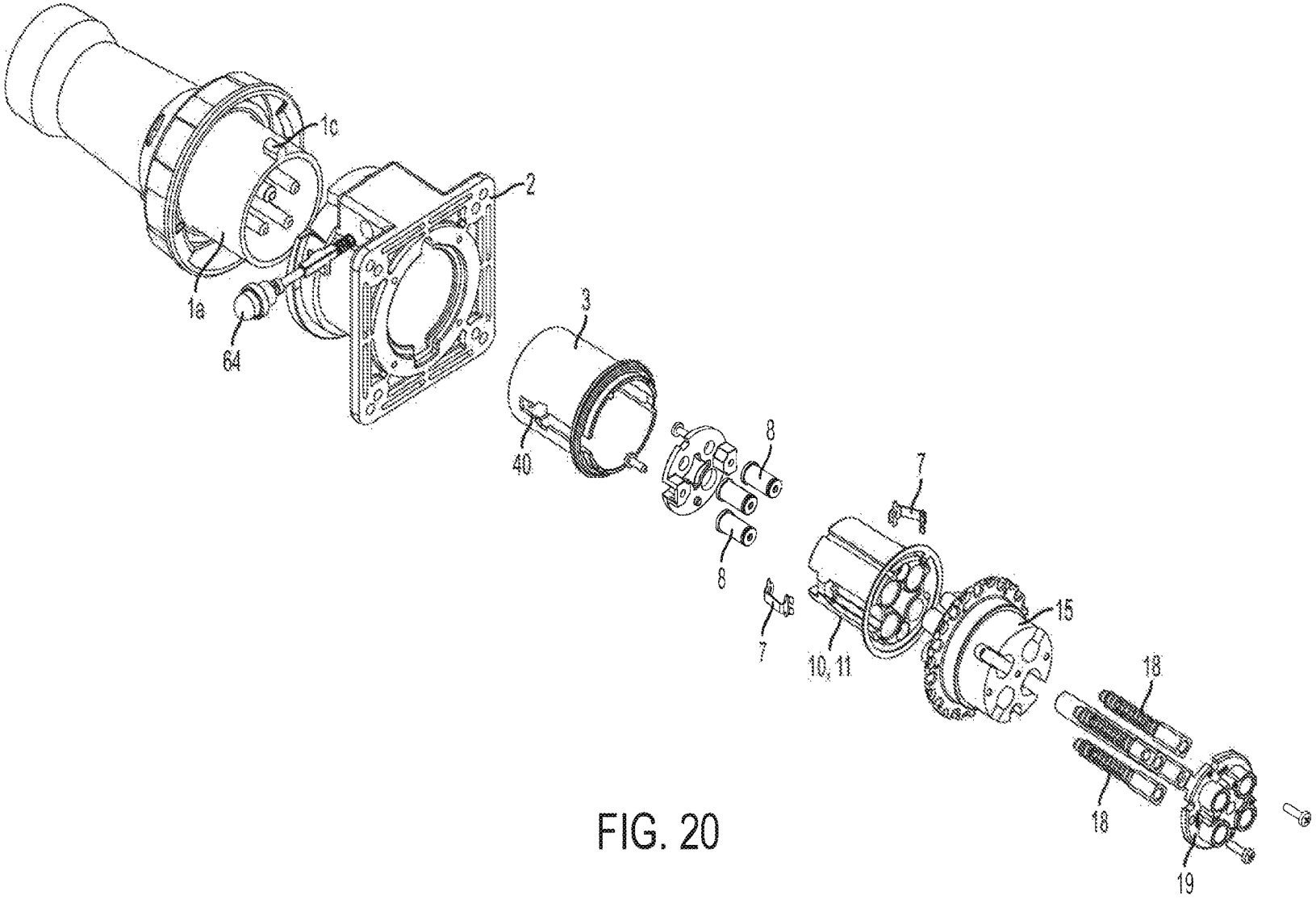
FIG. 20 is an exploded perspective view of a third receptacle embodiment according to the invention shown with a standard male plug.
Figure 21C:
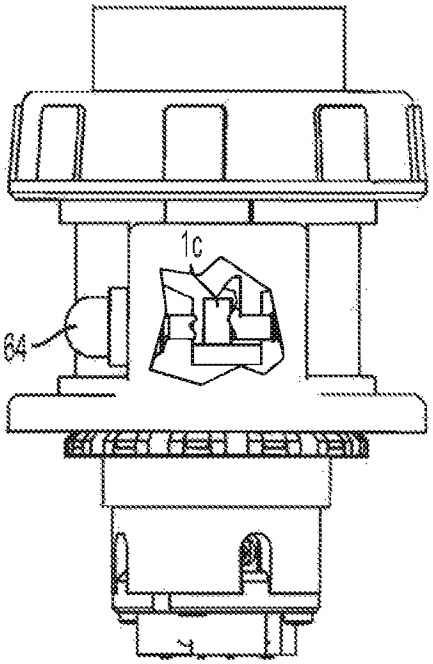
FIGS. 21A-21C are detail views of portions of the receptacle of FIG. 20 showing the sequence of insertion of the plug into the receptacle.
Figure 21B:
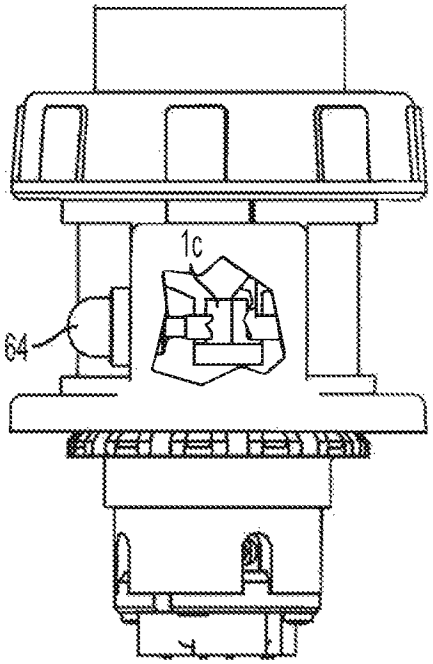
Figure 21A:
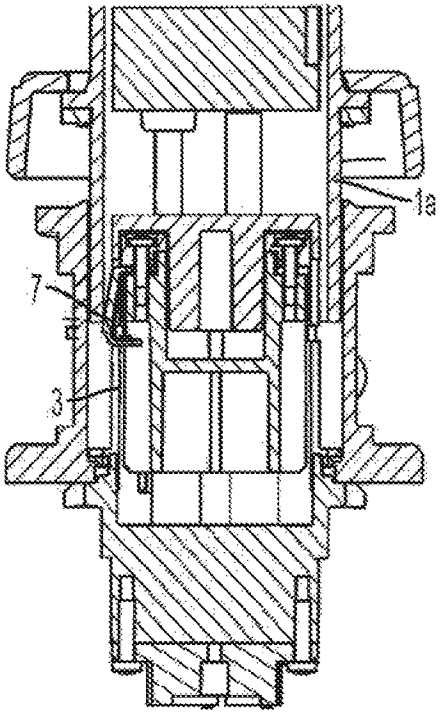
Figure 22B:
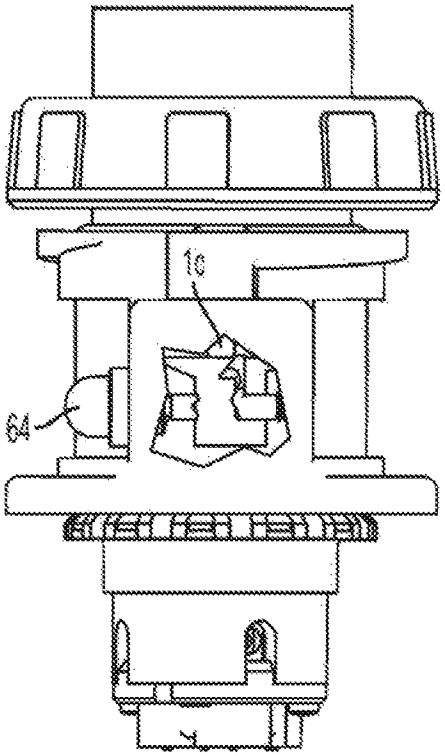
FIGS. 22A and 22B are detail views of portions of the receptacle of FIG. 20 showing the sequence of removal of the plug from the receptacle.
Figure 22A:
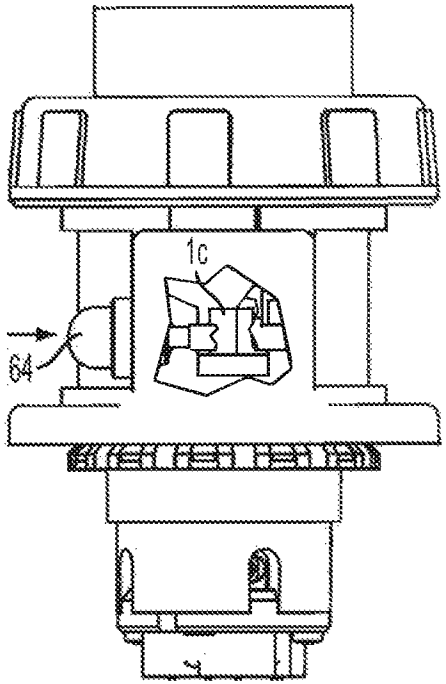

The sequence of removal is also a two step process and is shown in FIGS. 19A-19C. In the first step, depressing the second latch button 61 releases the plug and partially ejects it to its intermediate parked position, where the plug is retained by the first latch 60 in a non-energized state. In the second step, the first button is depressed to release the first latch 60, allowing complete withdrawal of the plug. Intermediate retention of the plug by the first latch keeps the plug from inadvertently dropping to the floor during unplugging. In the event the sleeves and the pressure contacts weld while energized, they can be separated safely by holding the second latch in its released state and pulling the plug and the receptacle apart until the first latch arrests the withdrawal.

Third Embodiment (FIGS. 20-22B)

The embodiment of FIGS. 20-22B has essentially the same components as the second embodiment, but only one latch 64 (instead of two) that operates tangentially. The latch is spring-biased toward a latched position and has a beveled leading surface (ramp) 65; a flat trailing surface (shoulder) 66; a release shaft; and an external release button, which when pressed moves the shaft and its latch against the spring force tangentially of the body and the plug. During plug insertion (FIGS. 21A-21C), the retaining clips 7 function in the same way to temporarily hold the sleeves back from the pressure contacts, but the single latch does not retain the plug until the fully seated plug pins are energized through the fully displaced and energized sleeves. During plug removal (FIGS. 22A and 22B), depressing the latch button releases the plug, which is at least partially ejected by the return springs to separate the sleeves from the pressure contacts.

Fourth Embodiment (FIGS. 22-2C)

As compared to the second embodiment, this fourth embodiment has the same pressure contact arrangement, but it has a different sleeve carrier and sleeve carrier housing arrangement, which nevertheless function in a similar manner. This third embodiment also has two spring-loaded, button-actuated latches 70, 71 that control plug movement, but they operate in a somewhat different manner as compared to the first embodiment. Referring to FIGS. 24A-24D, the first (upper) latch 70 has the same type of beveled leading surface (ramp) and is automatically displaceable by the plug tab, but it does not latch over (capture) the plug tab during the initial phase of plug insertion. The second (lower) latch 71 has flat top and bottom surfaces 72, 73.

Figure 23:
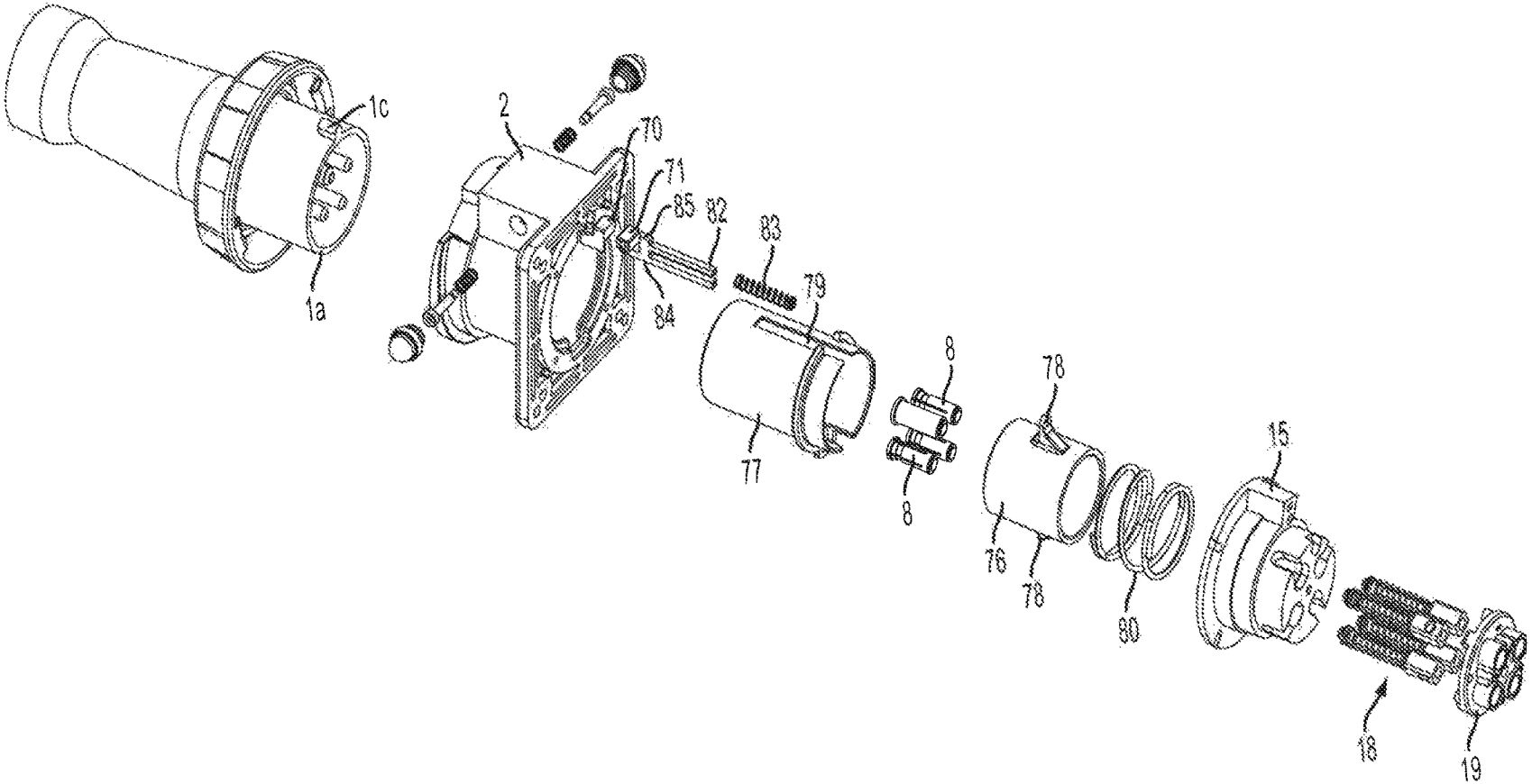
FIG. 23 is an exploded perspective view of a fourth receptacle embodiment according to the invention shown with a standard male plug.
Figure 24A:
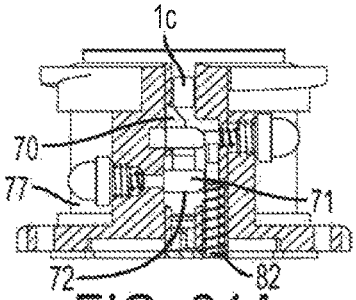
FIGS. 24A-24G are detail views of portions of the receptacle of FIG. 23 showing the sequence of insertion of the plug into the receptacle.
Figure 24B:
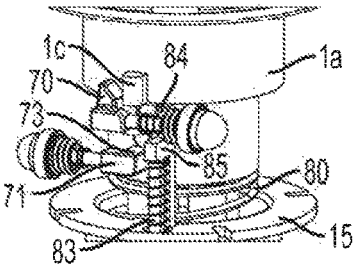
Figure 24C:
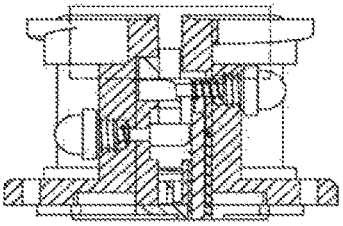
Figure 24D:
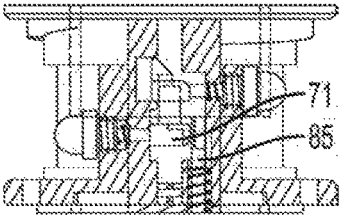
Figure 24E:
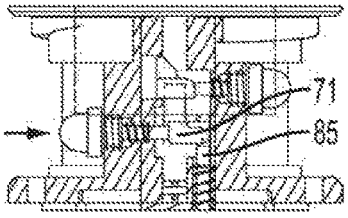
Figure 24F:
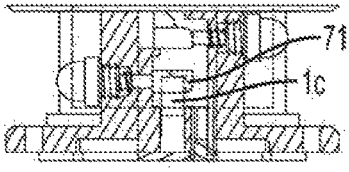
Figure 24G:
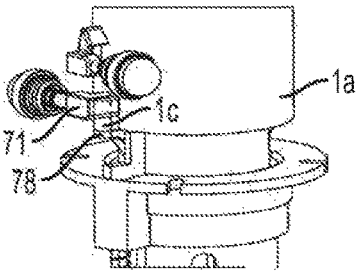

Referring to FIG. 23, the sleeve carrier 76 of this embodiment has two integral, diametrically opposed arms 78 that project laterally through respective axial guide slots 79 in the sleeve carrier housing 77. A single large helical carriage return spring 80 biases the sleeve carrier 76 away from the pressure contacts 18. Referring to FIGS. 23-24G, an L-shaped, axially movable safety plunger 82 is biased by a helical spring 83 toward the front end of the receptacle upper housing. The safety plunger has a plug-engageable upper leg 84 and a lower leg 85 that blocks lateral actuating movement of the second latch 71 until the rim of the inserted plug has moved past the first latch 70 and up to the second latch 71, which blocks further insertion of the plug. At this point the plug pins are fully engaged with the sleeves and the plug rim has displaced the safety plunger so that its lower leg 85 no longer blocks the second latch 71 (see FIG. 24D). Actuation of the now freed second latch 71 (FIG. 24E) unblocks the plug and allows its rim to engage the sleeve carrier arms 78. During final insertion of the plug (FIGS. 24F and 24G), the carrier and its sleeves are forced toward the pressure contacts, compressing the carriage return spring and bringing the sleeves into electrical contact with the tips of the pressure contacts. At this point the second latch 71 snaps over the plug tab 1*e*, locking the plug to the receptacle in the energized state (see FIGS. 24F and 24G).

Figure 25A:
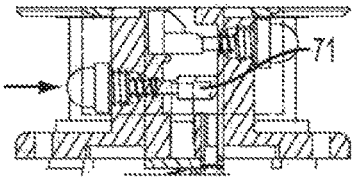
FIGS. 25A-25C are detail views of portions of the receptacle of FIG. 23 showing the sequence of removal of the plug from the receptacle.
Figure 25B:
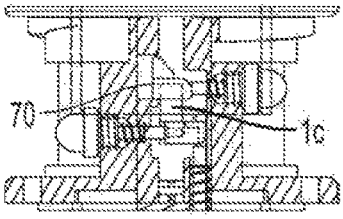
Figure 25C:
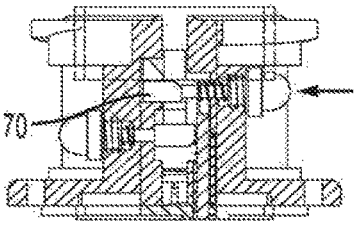

The sequence of removal (unplugging) is a two-step process and is shown in FIGS. 25A-25C. First, the second button is pressed to release the second latch 71, which allows the return spring 80 to retract the sleeve carrier, separating the sleeves from the pressure contacts and partially ejecting the plug to the point where it is retained by the first latch 70 in a non-energized state (see FIG. 25B). In the second step, the first button is pressed to release the first latch 70, allowing complete withdrawal of the plug (see FIG. 25C).

Fifth Embodiment (FIGS. 26-37)

Figure 26:
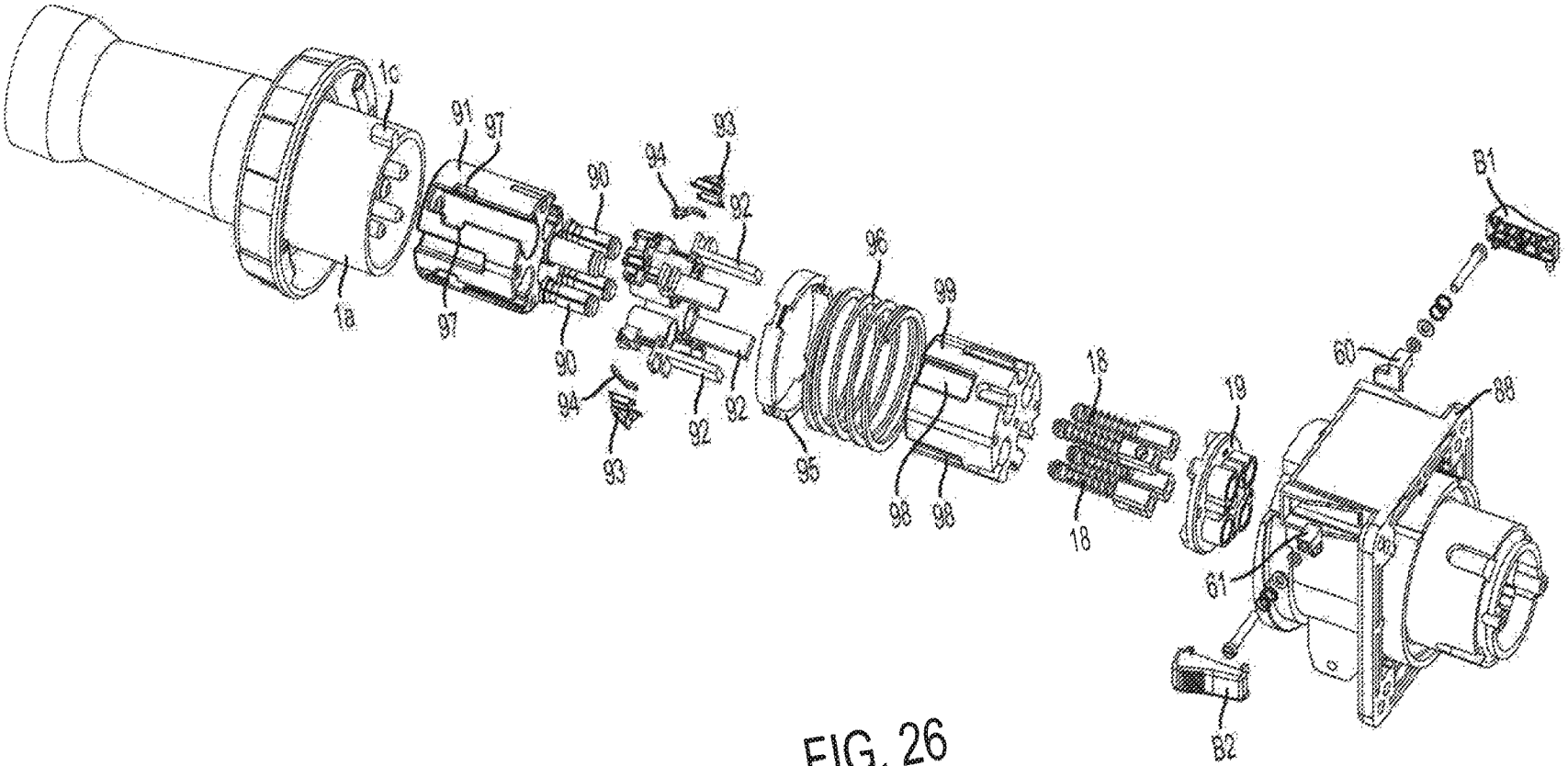
FIG. 26 is an exploded perspective view of a fifth receptacle embodiment according to the invention shown with a standard male plug.

This embodiment has the same pressure contact arrangement as the second embodiment (see FIG. 26). It also has essentially the same two-latch arrangement as the second embodiment, except that the external actuators are toggle buttons B1, B2 pivoted to the receptacle housing (see FIG. 33) instead of wholly shaft-supported round boots. It mainly differs from the other embodiments in that the individual sleeves move, in unison, relative to a fixed sleeve carrier 91 during plug insertion and removal. Also, unlike the other embodiments, the internal components of this fifth embodiment (see FIG. 26) are mated to the upper receptacle housing 88 through its open front end, rather than to its underside.

Figure 27:
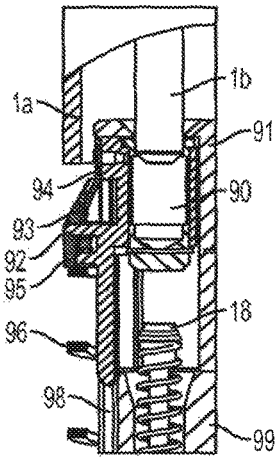
FIG. 27 is a partial sectional view of the receptacle of FIG. 26.
Figure 28:
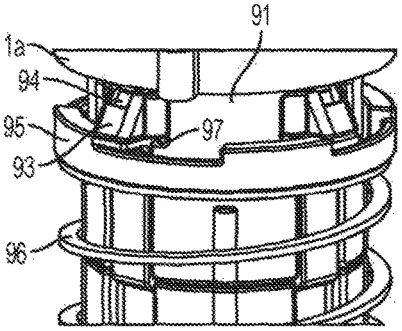
FIG. 28 is a partial perspective view of the receptacle of FIG. 26 with some parts removed.
Figure 29:
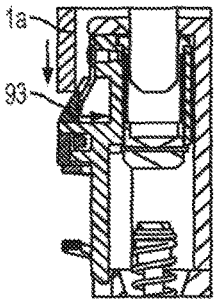
FIGS. 29-35 are detail views of portions of the receptacle of FIG. 26 showing the sequence of insertion of the plug into the receptacle.
Figure 30:
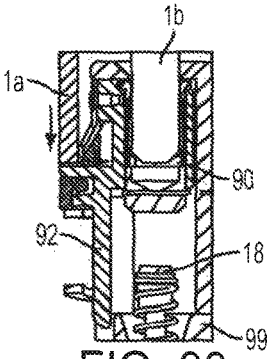
Figure 31:
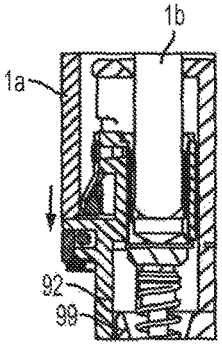
Figure 32:
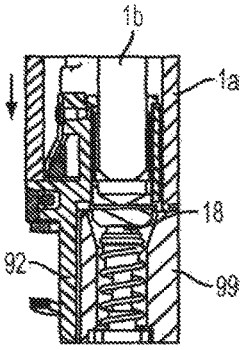
Figure 33:
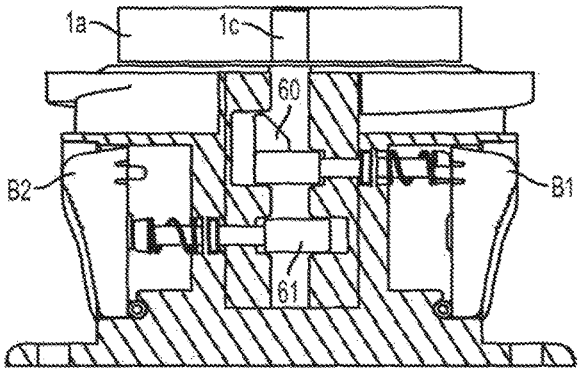
Figure 34:
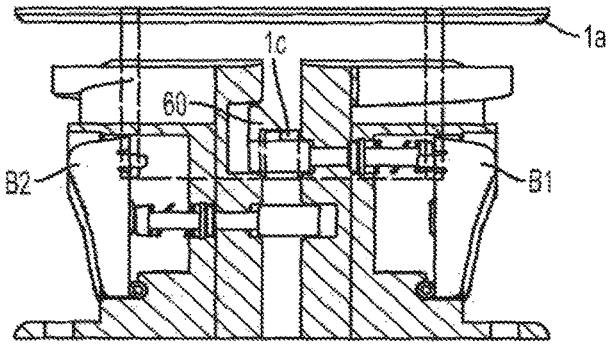
Figure 35:
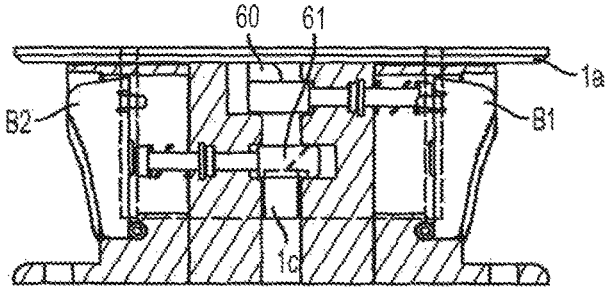
Figure 36:
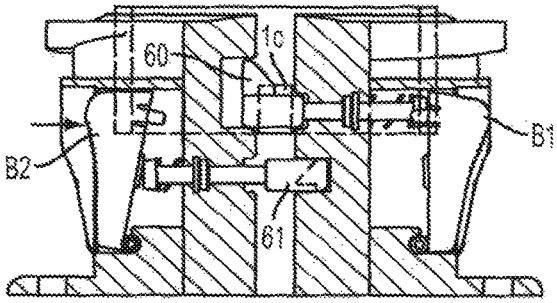
FIGS. 36 and 37 are detail views of portions of the receptacle of FIG. 26 showing the sequence of removal of the plug from the receptacle.
Figure 37:
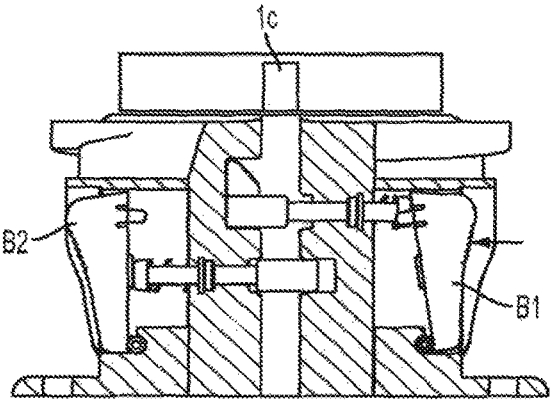

Referring to FIGS. 26-28, each contact sleeve 90 is part of an assembly that includes a sleeve holder 92 and a leaf spring-loaded (94), outwardly biased wedge 93. The bottom of the wedge normally abuts blocking shoulders 97 near the sleeve carrier's outer edge, the wedges thus positively holding the sleeve holders and their sleeves at the sleeve carrier's front (mating) end. The sleeve holders are coupled together by an anti-tamper ring 95—which also ensures their simultaneous movement when released—and they are biased toward the front end of the sleeve carrier by a common encircling coil return spring 96.

Complete mechanical and electrical coupling of the male plug and the receptacle is accomplished in two stages through seamless, strictly axial translation of those parts. The first stage involves mechanical coupling (see FIGS. 27, 28 and 33) whereby the pins 1*b* of the plug are mated with and pressed into the respective sleeves of the receptacle. About half way through pin/sleeve engagement the rim (leading edge) of the plug shroud 1*a* contacts the sleeve-holding wedges 93 (see FIG. 29). As the engagement continues, the plug shroud rides over the tapered outer surfaces of the wedges 93, displacing the wedges radially inward until they clear the blocking shoulders 97 of the sleeve carrier (see FIG. 30). Meanwhile, the plug tab 1*e* has engaged the ramp of the first latch 60, deflected the latch sideways and moved past it, whereupon the first latch has snapped back audibly so that its trailing shoulder blocks the trailing end of the plug tab (see FIG. 34). Thus, at the end of the first stage, the first latch retains the male plug in the body with the pins 1*b* and the sleeves 90 fully engaged (see FIG. 30); but the sleeves remain spaced from the pressure contacts 18, leaving the assembly physically coupled but with the plug in a non-energized state.

The second stage involves electrical coupling to energize the plug. With the sleeve-holding wedges 93 now clear of the blocking shoulders 97, further axial mating of the plug with the receptacle drives the sleeve holders 92 and their sleeves 90 inward within the fixed carrier and along grooves 98 on the outside of the terminal carrier 99, bringing their silver tips into engagement with the silver tips of the pressure contacts 18 (see FIGS. 31 and 32). Meanwhile, the coil return spring 96 has been compressed; and the plug tab has engaged the ramp of the second latch 61, deflected that latch sideways and moved past it, whereupon the second latch has snapped back audibly so that its trailing shoulder blocks the trailing end of the tab (see FIG. 35). Thus, at the end of the second stage, the second latch retains the plug in the body with its pins in an energized state.

Uncoupling (removal) is a two-step process. First, the second button is pressed to release the second latch, which allows the coil return spring (not shown in FIGS. 33-37) partially to eject the plug to the point where it is retained by the first latch (see FIG. 36). In this position the silver contact tips are separated, leaving the plug in a non-energized state. In the second step (see FIG. 37), the first button is pressed to release the first latch, allowing complete withdrawal of the plug.

Sixth Embodiment (FIGS. 38-40C)

Figure 39A:
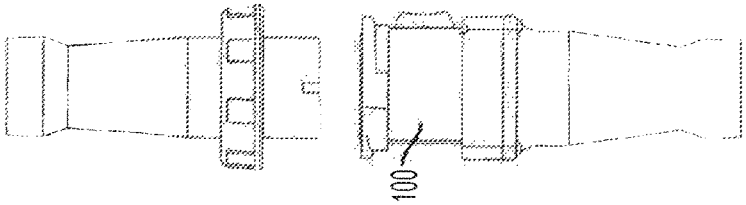
FIG. 39A is an elevational view of the assembled receptacle of FIG. 38 and a standard male plug.
Figure 38:
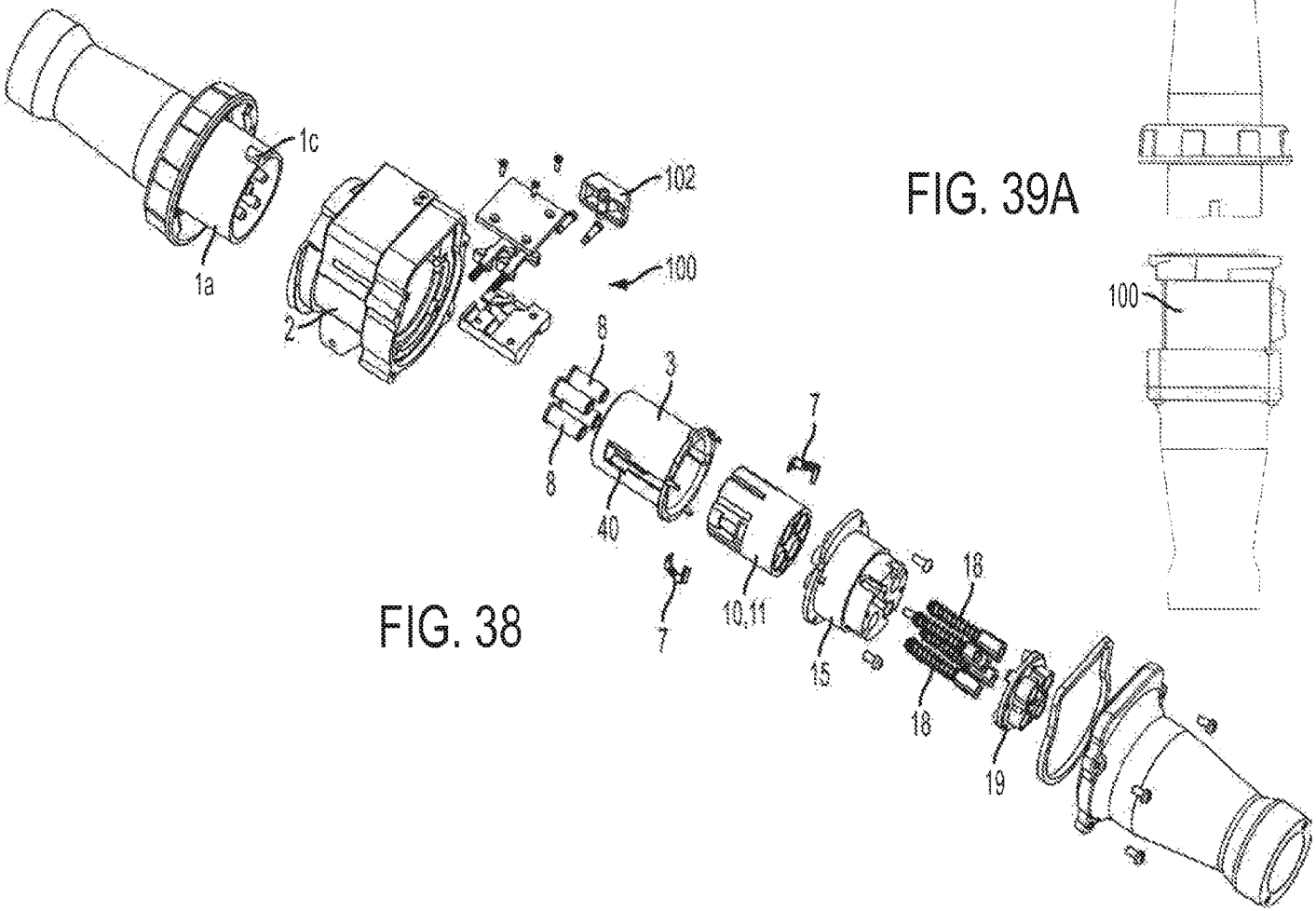
FIG. 38 is an exploded perspective view of a sixth receptacle embodiment according to the invention shown with a standard male plug.
Figure 39E:
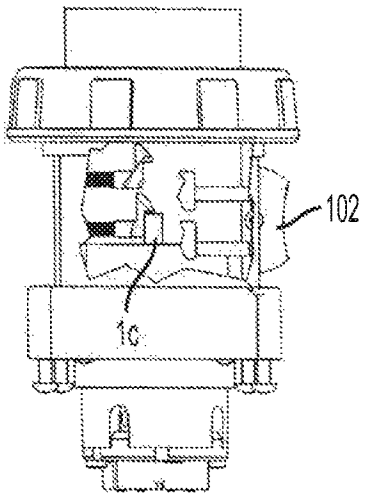
FIGS. 39B-39E are detail views of portions of the receptacle of FIG. 38 showing the sequence of insertion of the plug into the receptacle.
Figure 39D:
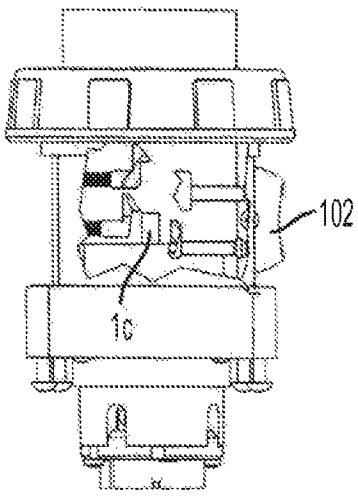
Figure 39C:
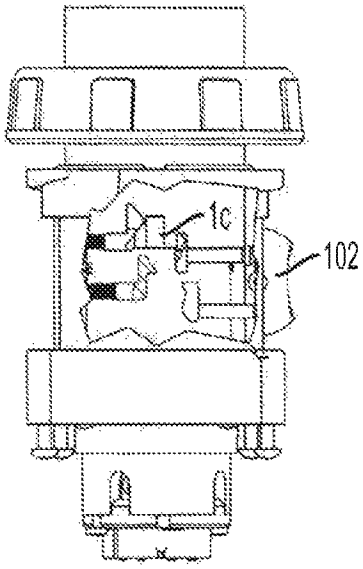
Figure 39B:
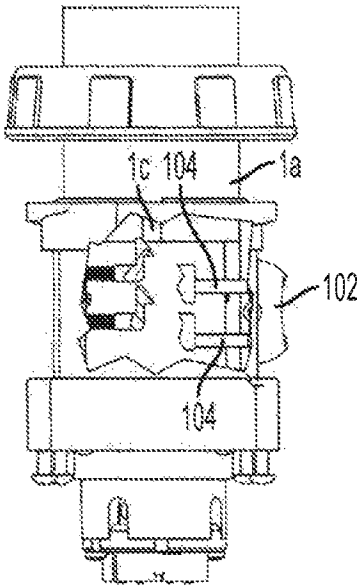
Figure 40C:
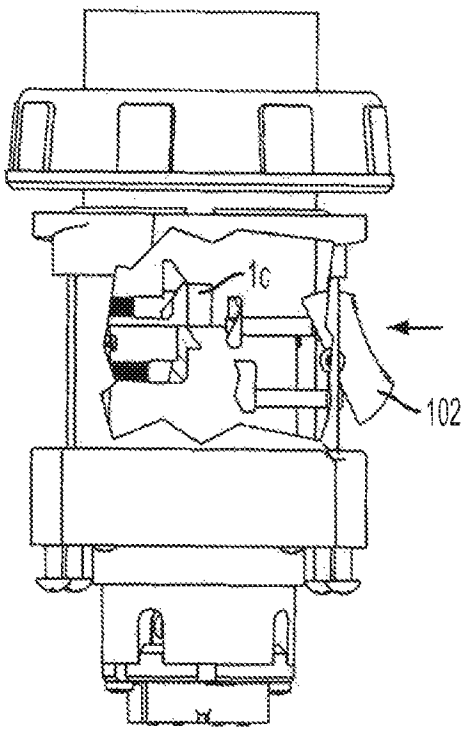
FIGS. 40A-40C are detail views of portions of the receptacle of FIG. 38 showing the sequence of removal of the plug from the receptacle.
Figure 40B:
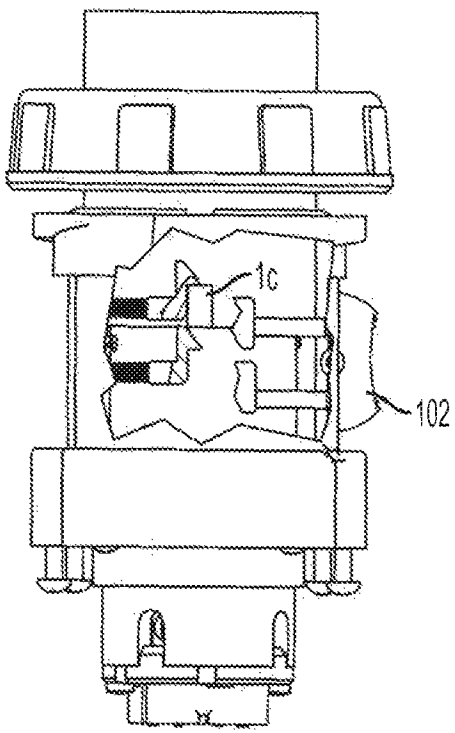
Figure 40A:
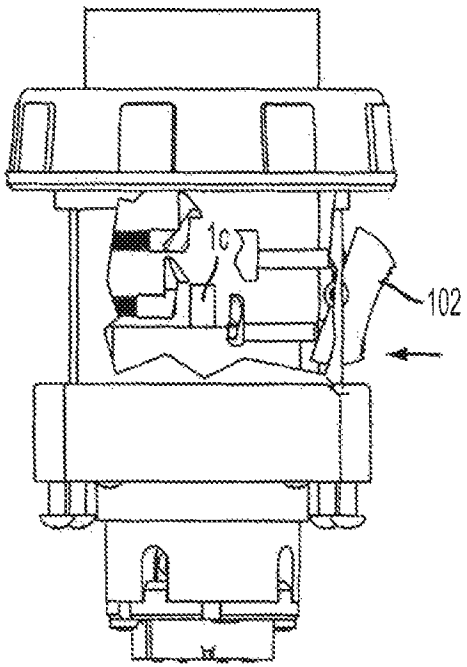

This embodiment is substantially identical to the second embodiment in structure and operation except for the latching arrangement, which can be used in any embodiment that requires two latches. Referring to FIGS. 38, 39A and 39B, the latches are arranged for operation from only one side of the device by means of a three-position toggle 102 pivoted at its center to the side of a latching module 100, which is mounted to the receptacle housing and includes the latches, latch springs, latch guides and a latch cover. Each end of the toggle 102 bears against the head of a respective toggle actuator screw 104, the threaded end of which is connected to a respective latch. Pressing on the lower portion of the toggle during plug removal actuates the second latch (see FIG. 40A); pressing on the upper portion of the toggle actuates the first latch (see FIG. 40C). The neutral position of the toggle is shown in FIG. 40B. As in the second embodiment, the latches are actuated automatically during plug insertion (see FIGS. 39B, 39C, 39D and 39E).

Seventh Embodiment (FIGS. 41-43C)

Figures 41, 42A:
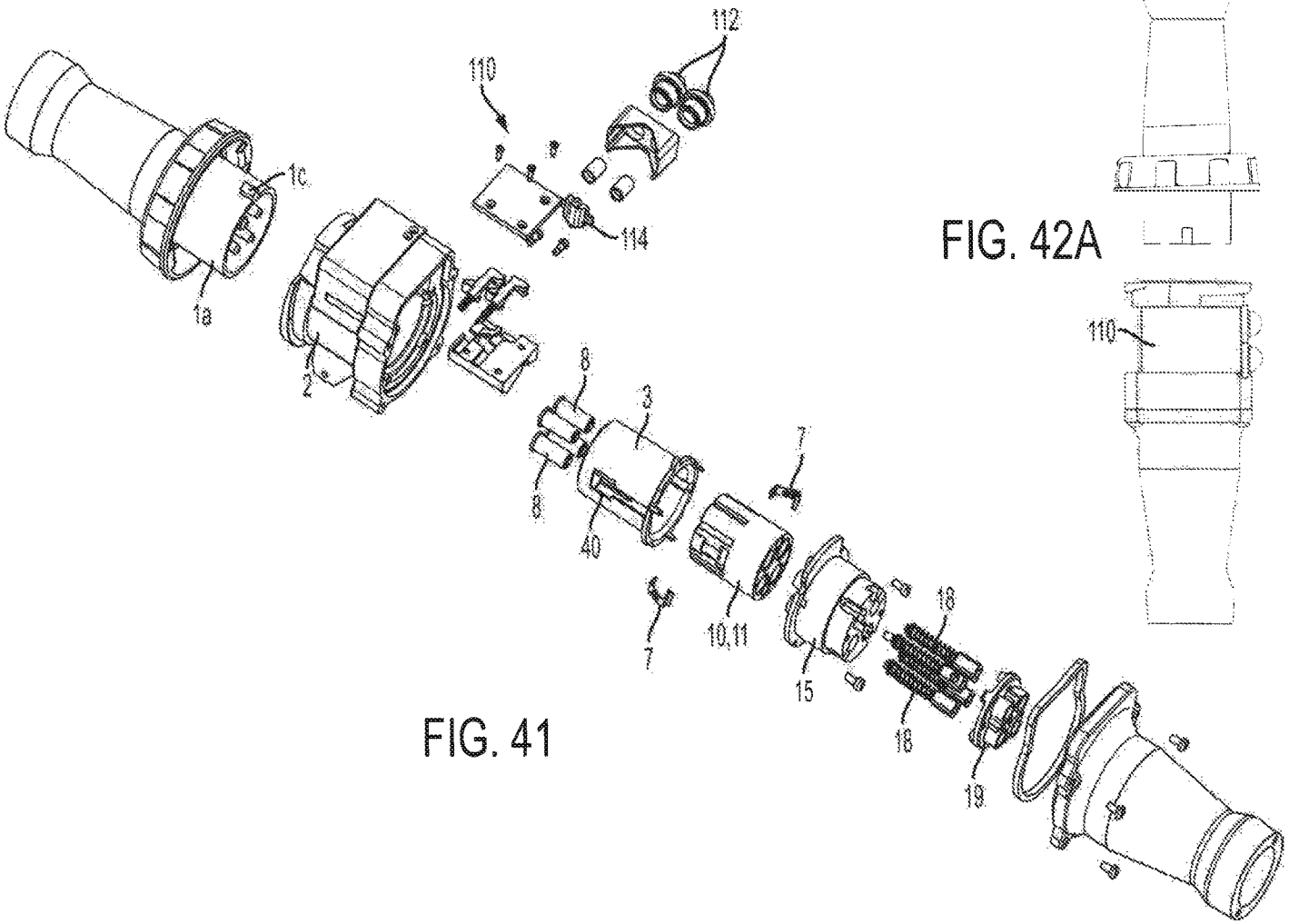
FIG. 41 is an exploded perspective view of a seventh receptacle embodiment according to the invention shown with a standard male plug.
FIG. 42A is an elevational view of the assembled receptacle of FIG. 41 and a standard male plug.
Figure 42B:
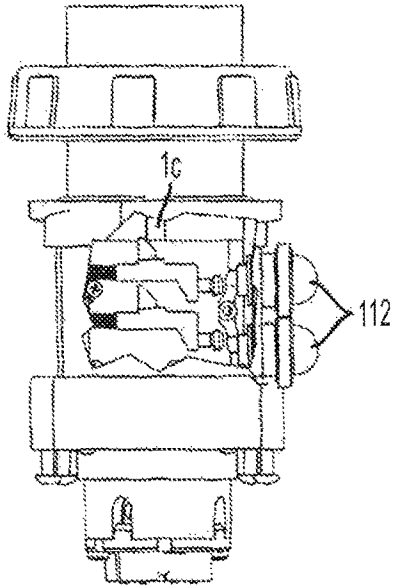
FIGS. 42B-42E are detail views of portions of the receptacle of FIG. 41 showing the sequence of insertion of the plug into the receptacle.
Figure 42C:
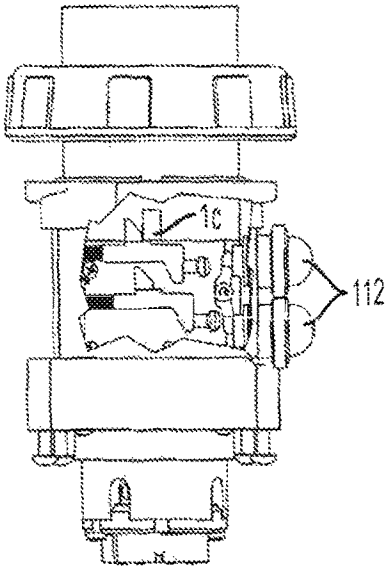
Figure 42D:
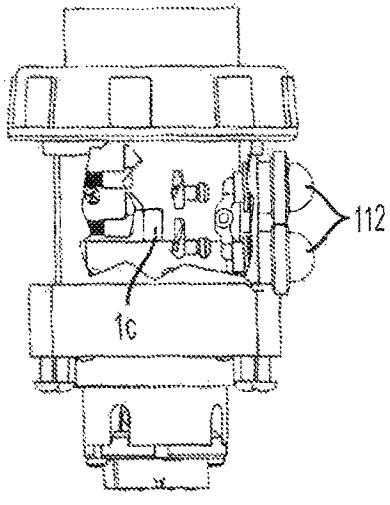
Figure 42E:
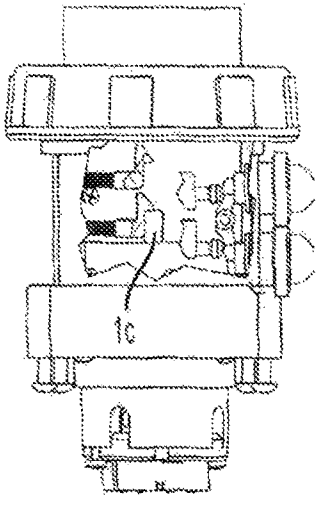
Figure 43C:
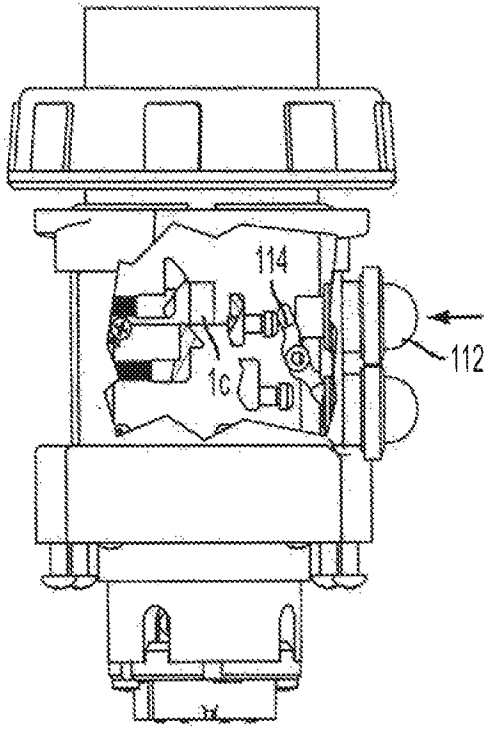
FIGS. 43A-43C are detail views of portions of the receptacle of FIG. 41 showing the sequence of removal of the plug from the receptacle.
Figure 43B:
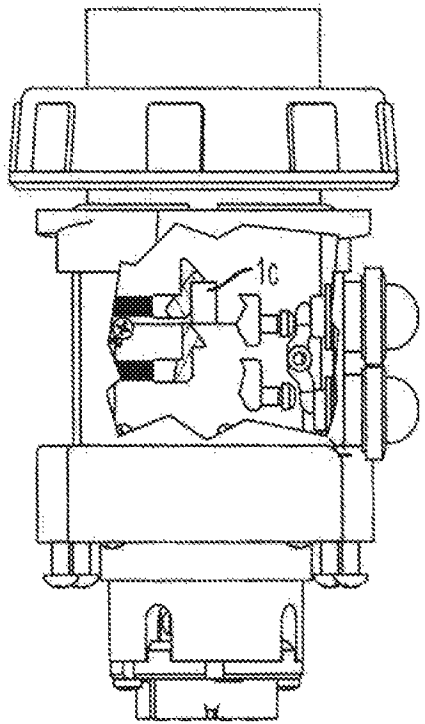
Figure 43A:
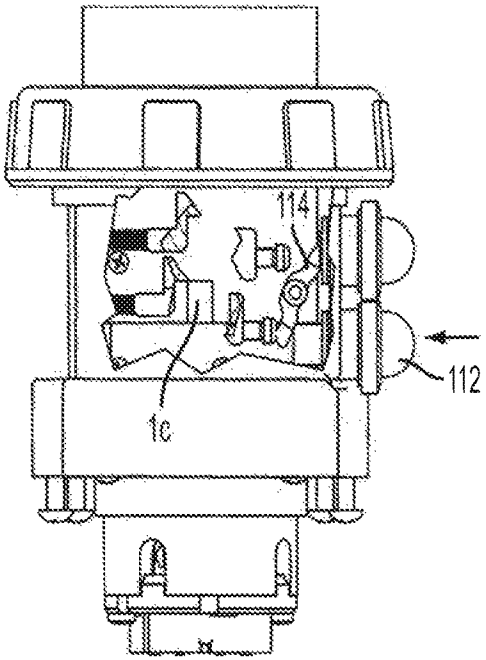
Figure 48F:
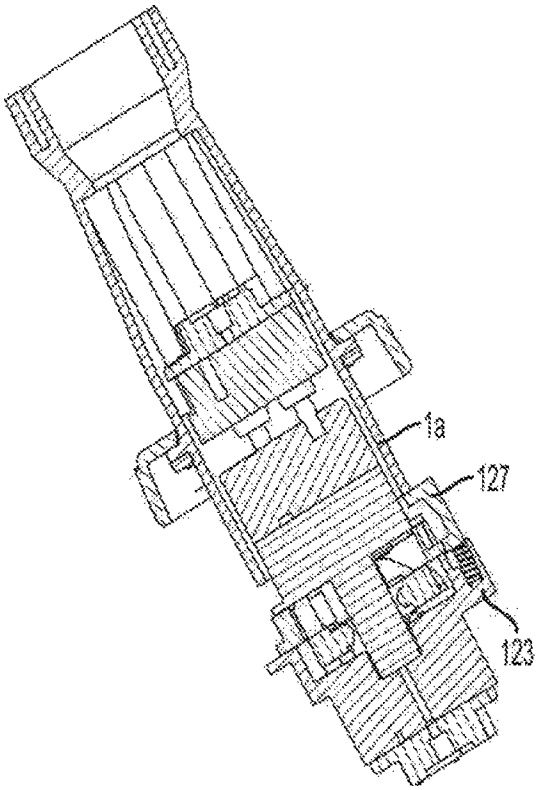
FIG. 48F is a longitudinal sectional view through the partially mated plug and receptacle of FIG. 44.
Figure 48C:
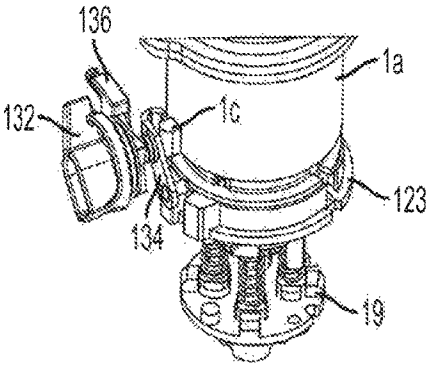
FIGS. 48A-48E are detail views of portions of the receptacle of FIG. 44 showing the sequence of insertion of the plug into the receptacle.
Figure 48B:
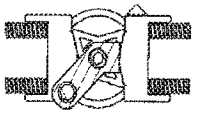
Figure 48E:
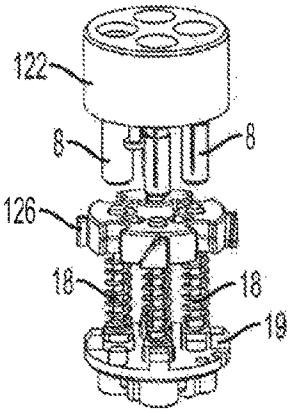
Figure 48A:
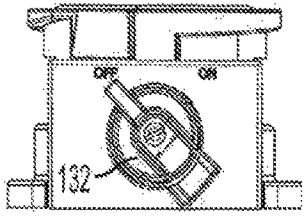
Figure 48D:
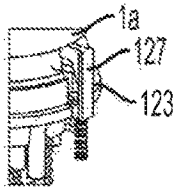
Figure 49F:
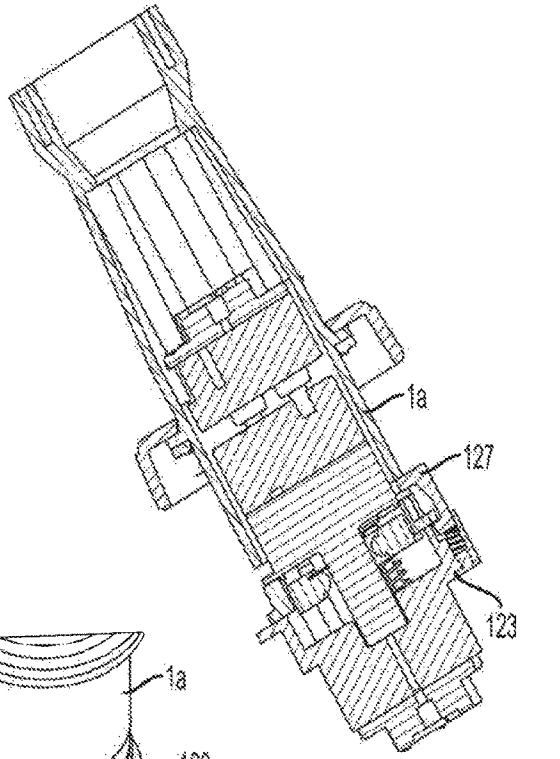
FIG. 49F is a longitudinal sectional view through the fully mated plug and receptacle of FIG. 44.
Figure 49A:
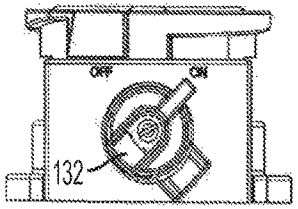
FIGS. 49A-49E are detail views of portions of the receptacle of FIG. 44 showing the sequence of removal of the plug from the receptacle.
Figure 49B:
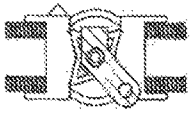
Figure 49D:
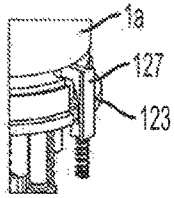
Figure 49C:
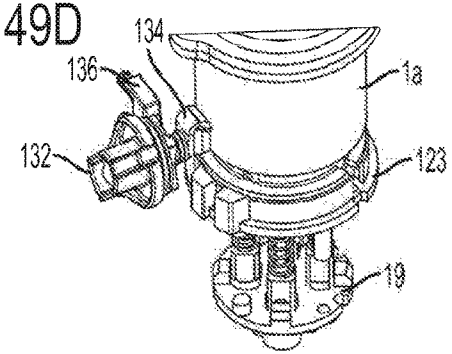
Figure 49E:
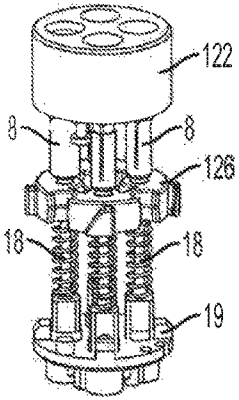

This embodiment is substantially identical to the sixth embodiment except for a slightly different latching module 110, which can be used in any embodiment that requires two latches. Referring to FIGS. 41, 42A and 42B, external button-headed pistons 112 on the latching module bear against the end portions of an internal toggle plate 114, the opposite sides of which bear against the heads of respective actuator screws 116 that are attached to the respective latches. Pressing on the lower button during plug removal actuates the second latch (see FIG. 43A); pressing on the upper button actuates the first latch (see FIG. 43C). The neutral position of the toggle plate 114 is shown in FIG. 43B. As in the sixth embodiment, the latches are actuated automatically during plug insertion (see FIGS. 42B, 42C, 42D and 42E).

Type III Embodiment (FIGS. 44-49F)

Referring to FIG. 44, this receptacle embodiment includes within its housing four braided, spring-loaded pressure contacts 18 (as described previously) supported by a terminal retainer cap 19 in a terminal retainer 15. Four sleeves 8 are carried in a sleeve contact carrier assembly (top 122 and bottom 123). Also included are an axially movable terminal drive plate 125, a rotatable cam wheel 126 and two spring-loaded safety plungers 127. One side of the receptacle's upper housing has an actuator assembly 130 that includes:

a) An actuator knob 132 with a LOTO (lockout/tagout) hoop feature and a sealed rotary shaft/pin retaining/drive assembly 134 with a plug locking feature;

b) Two spring-loaded sliding side rails 136; and c) A face-sealing gasket 137 and a retainer plate 138 with LOTO feature and markings with ON & OFF text for intuitive use.

Further structural details and operation of this embodiment are as follows and as illustrated and described in FIGS. 45-49F.

A drive pin of the actuator assembly transmits rotary ON/OFF knob action in the X-Y plane to the cam wheel 126, which rotates in the X-Z plane. The cam wheel has a ramp on the face of an X-Z plane which extends down the Y axis and interfaces with an opposing ramp on the face of the terminal drive plate 125, also in the X-Z plane. As the cam wheel 126 rotates, the angled surfaces convert the rotary action into linear Y axis translation of the terminal drive plate 125, which moves the braided, spring-loaded pressure contacts 18 simultaneously, making or breaking the circuit with the respective sleeve contacts 8. The ground terminal always breaks last and makes first. Clockwise rotation of the cam wheel (when viewed from the plug end) raises the terminal drive plate; counterclockwise rotation of the cam wheel lowers the terminal drive plate.

The bottom sleeve contact carrier 123 is a fixed component that contains a center spline, which provides dielectric insulation between adjacent contacts and linear Y-axis guiding and bearing surfaces between the spline and mating features on the terminal drive plate 125. Bearing surfaces on the terminal drive plate are optimized to minimize cocking potential and sliding friction. Surface contact area between the spline and the terminal drive plate is limited to the mid-plane of the terminal drive plate thickness, where a radius and clearance reliefs define hourglass sections in Y-Z and X-Z planes.

The two safety plungers 127, when actuated by the rim of a plug, allow cam wheel rotation. When no plug is present, the plungers restrict any cam wheel or knob rotation by filling respective slots in the cam wheel. The plungers ensure that the receptacle cannot be turned "ON" until the mating plug has been fully inserted. Plug insertion pushes the plungers to a depth along the Y axis where they no longer block the slots in the cam wheel.

The knob-driven rotary shaft assembly 134 consists of a shaft and a plate with the drive pin at its lower end (which engages the cam wheel) and a U-shaped latching/locking feature (hook or catch) at its upper end. When the plug is fully inserted in the housing, a turn of the knob to the "ON" position moves the catch transversely of the Y-axis to capture the trailing end of the plug tab (see FIG. 49C).

The rotary ON/OFF knob 132 drives actuating cam wheel 126, which is attached to the receptacle housing on an X-Y plane and rotates about the Z-axis. The actuating cam has a 4-pointed star-shaped profile that interfaces with the movable, spring-loaded side rails 136 contained in the housing that slide along the X-axis. As the knob turns, the larger pointed cam features contact and displace the spring-loaded side rails 136 outwardly; then the smaller features between the points allow the rails to move inwardly again. This cam profile, when combined with the side spring loading, creates a torsional loading that accelerates the final rotation of the knob past the center point of the rotary deflection, resulting in a snapping over or "over-center" knob action. The over-center knob action also provides resistance to vibration and inadvertent knob rotation. The torsional spring loading about the Z-axis is transmitted to the cam wheel and the terminal drive plate to provide quick Y axis loading/unloading of the butt contacts to make/break the circuit quickly, minimizing arcing potential.

While exemplary embodiments have been chosen to illustrate the invention, it will be understood by those skilled in the art that various changes, modifications, additions, and substitutions are possible, without departing from the scope and spirit of the invention. Additions could include additional or other types of arrangements that provide an indication of the status of the device. For example, the receptacle could have an LED lead frame assembly including resistors that reduce the line voltage to equal the operating voltage and load of the LED and maximize its life expectancy. Leads from the resistors would be terminated to terminals of the braided pressure contacts on one end and terminated to sleeves on the opposite end. An LED indication would occur in any of the following scenarios:

(1) LIGHT CHANGES COLOR: Power applied and internal switching mechanism de-energized, LED indicator displays "Green" or similar for "all clear" indication. Internal switching mechanism then energized, LED indicator displays "Red" for "hot" indication.

(2) LIGHT CHANGES STATE FROM DARK TO ILLUMINATED: Power applied and internal switching mechanism de-energized, LED indicator displays no light (similar to when main power is disconnected). Internal switching mechanism then energized, LED indicator displays "Red" for "hot" indication or "Green" to indicate circuit is active.

All indicator schemes would be supported by icons or text on the receptacle housing to facilitate communication of the product function to the user. The LED indication provides product users with immediate feedback on the power status of the switched connector, including whether the contacts weld while energized, which would require prompt corrective action. The indication would be visible from a distance, facilitating maintenance and start-up.

Alternatively or in addition, status indication could be accomplished in a mechanical fashion. For example, the receptacle could have a visual indicator such as a sliding or rotating colored panel or a colored sleeve collar riding over a colored drum or sphere. Where a movable colored outer panel or surface covers an inner panel or surface, a contrasting color could be used to designate the changing state of power.

What is claimed is:

1. An electrical receptacle for use with a plug having a shroud surrounding one or more plug contacts, the receptacle comprising:

a housing having an outer end and a cavity for receiving a plug shroud:

a retainer positioned in the housing, the retainer having base portion and a protrusion extending from the base and defining an aperture, wherein the protrusion includes a cylindrical member;

an inner contact connected to the retainer and having a portion extending through the aperture, wherein the inner contact includes a moveable contact tip and a spring biasing the contact tip, wherein at least a portion of the spring is positioned in the cylindrical member;

a sleeve carrier positioned in the housing and axial moveable with respect to the retainer, the sleeve carrier at least partially defining a chamber receiving the protrusion; and a sleeve contact connected to the sleeve carrier and engageable by a plug contact, wherein the sleeve contact is electrically disconnected from the inner contact in a first state and electrically connected to the inner contact in a second state.

2. The receptacle of claim 1, wherein the sleeve carrier is biased away from the inner contact by a biasing member.

3. The receptacle of claim 1, wherein the retainer includes a clip that prevents movement of the sleeve carrier prior to insertion of the plug and is displaced by a plug shroud during insertion of a plug to allow movement of the sleeve carrier.

4. The receptacle of claim 1, wherein the protrusion slidably engages the sleeve carrier during transition from the first state to the second state.

5. The receptacle of claim 1, wherein a volume of the chamber varies as the sleeve carrier moves with respect to the retainer.

6. The receptacle of claim 5, wherein the volume of the chamber is at a minimum when a plug is fully inserted.

7. The receptacle of claim 5, wherein the chamber is isolated from the housing.

8. An electrical receptacle for use with a plug having a shroud surrounding one or more plug contacts, the receptacle comprising:

a housing for receiving a plug shroud;

a retainer positioned in the housing, the retainer having base portion and a cylindrical member extending from the base and defining an aperture;

an inner contact connected to the retainer and having a portion extending through the aperture, wherein the inner contact includes a moveable contact tip and a spring biasing the contact tip;

a sleeve carrier positioned in the housing and axial moveable with respect to the retainer, the sleeve carrier at least partially defining a chamber receiving the cylindrical member; and a sleeve contact connected to the sleeve carrier and engageable by a plug contact, wherein the sleeve contact is electrically disconnected from the inner contact in a first state and electrically connected to the inner contact in a second state.

9. The receptacle of claim 8, wherein the sleeve carrier is biased away from the inner contact by a biasing member.

10. The receptacle of claim 8, wherein the retainer includes a clip that prevents movement of the sleeve carrier prior to insertion of the plug and is displaced by a plug shroud during insertion of a plug to allow movement of the sleeve carrier.

11. The receptacle of claim 8, wherein the protrusion slidably engages the sleeve carrier during transition from the first state to the second state.

12. The receptacle of claim 8, wherein a volume of the chamber varies as the sleeve carrier moves with respect to the retainer.

13. The receptacle of claim 12, wherein the volume of the chamber is at a minimum when a plug is fully inserted.

14. The receptacle of claim 12, wherein the chamber is isolated from the housing.

15. An electrical receptacle for use with a plug having a shroud surrounding one or more plug contacts, the receptacle comprising:

a housing having an outer end and a cavity for receiving a plug shroud:

a retainer positioned in the housing, the retainer having base portion and a plurality of protrusions extending from the base and defining a plurality of apertures;

a plurality of inner contacts connected to the retainer, wherein one inner contact is positioned in each of the protrusions;

a plurality of sleeve carriers positioned in the housing and axial moveable with respect to the retainer, wherein each sleeve carrier is associated with a respective protrusion and at least partially defines a chamber receiving the respective protrusion; and a sleeve contact connected to each sleeve carrier and engageable by a plug contact, wherein the sleeve contacts are electrically disconnected from the inner contacts in a first state and electrically connected to the inner contacts in a second state.

16. The receptacle of claim 15, wherein each of the inner contacts includes a moveable contact tip and a spring biasing the contact tip.

17. The receptacle of claim 15, wherein the retainer includes a clip that prevents movement of the sleeve carrier prior to insertion of the plug and is displaced by a plug shroud during insertion of a plug to allow movement of the sleeve carrier.

18. The receptacle of claim 15, wherein the protrusion slidably engages the sleeve carrier during transition from the first state to the second state.

* * * * *